US010689011B2

(12) United States Patent
He et al.

(10) Patent No.: US 10,689,011 B2
(45) Date of Patent: Jun. 23, 2020

(54) WAGON AND VEHICLE BODY ASSEMBLY THEREOF

(71) Applicant: CRRC QIQIHAR ROLLING STOCK CO., LTD., Heilongjiang (CN)

(72) Inventors: Baichuan He, Heilongjiang (CN); Tianjun Zhao, Heilongjiang (CN); Zhenguo Wu, Heilongjiang (CN); Lei Yu, Heilongjiang (CN)

(73) Assignee: CRRC Qiqihar Rolling Stock Co., Ltd. (CN)

( * ) Notice: Subject to any disclaimer, the term of this patent is extended or adjusted under 35 U.S.C. 154(b) by 426 days.

(21) Appl. No.: 15/545,354

(22) PCT Filed: Aug. 24, 2016

(86) PCT No.: PCT/CN2016/096576

§ 371 (c)(1),
(2) Date: Jul. 21, 2017

(87) PCT Pub. No.: WO2017/059749

PCT Pub. Date: Apr. 13, 2017

(65) Prior Publication Data

US 2018/0001904 A1 Jan. 4, 2018

(30) Foreign Application Priority Data

Oct. 10, 2015 (CN) ..... 2015 1 0651438

(51) Int. Cl.
*B61D 7/02* (2006.01)
*B61D 39/00* (2006.01)
(Continued)

(52) U.S. Cl.
CPC ..... *B61D 7/02* (2013.01); *B61D 7/18* (2013.01); *B61D 7/26* (2013.01); *B61D 17/00* (2013.01); *B61D 39/001* (2013.01)

(58) Field of Classification Search
CPC ... B61D 7/02; B61D 7/18; B61D 7/26; B61D 17/00; B61D 39/001
See application file for complete search history.

(56) References Cited

U.S. PATENT DOCUMENTS 4,677,917 A * 7/1987 Dugge ..... B61D 7/18 105/248
5,263,421 A 11/1993 Lichty et al.
(Continued)

FOREIGN PATENT DOCUMENTS

AU 2014351100 A1 6/2015
CN 2465984 Y 12/2001
(Continued)

OTHER PUBLICATIONS

International Patent Application No. PCT/CN2016/096576: International Search Report dated Nov. 30, 2016, 16 pages.

*Primary Examiner* — Jason C Smith
(74) *Attorney, Agent, or Firm* — BakerHostetler

(57) ABSTRACT

A wagon and a car body assembly thereof are provided. The car body assembly includes at least two bogies, an underframe and a car body both supported on the two bogies, the car body includes a middle car body, and a discharge opening of the middle car body is arranged between the two bogies, and at least one end of the middle car body is further provided with an end car body, and a predetermined space is defined above the respective bogie by adjacent end walls of the middle car body and the end car body.

19 Claims, 15 Drawing Sheets

(51) Int. Cl.

| | |
|---|---|
| ***B61D 7/18*** | (2006.01) |
| ***B61D 17/00*** | (2006.01) |
| ***B61D 7/26*** | (2006.01) |

(56) References Cited

U.S. PATENT DOCUMENTS

| | | | | |
|---|---|---|---|---|
| 6,237,505 | B1 * | 5/2001 | Sande | B61D 7/02 105/247 |
| 7,908,975 | B2 * | 3/2011 | Forbes | B61D 7/02 105/247 |
| 2008/0066642 | A1 * | 3/2008 | Forbes | B61D 7/04 105/247 |
| 2017/0158207 | A1 * | 6/2017 | Senn | B61D 7/02 |
| 2018/0001904 | A1 * | 1/2018 | He | B61D 7/02 |
| 2018/0155977 | A1 * | 6/2018 | Watson | E01B 27/02 |
| 2018/0222495 | A1 * | 8/2018 | Huck | E05F 15/53 |
| 2018/0281824 | A1 * | 10/2018 | Reitz | B61D 7/28 |
| 2018/0334178 | A1 * | 11/2018 | Gillis | B61D 17/08 |
| 2019/0126946 | A1 * | 5/2019 | Shubs, Jr. | B61D 7/24 |
| 2019/0176852 | A1 * | 6/2019 | Taylor | B61D 7/26 |
| 2019/0176855 | A1 * | 6/2019 | Dolnik | B61D 19/005 |

FOREIGN PATENT DOCUMENTS

| | | | |
|---|---|---|---|
| CN | 2538589 | Y | 3/2003 |
| CN | 101200190 | A | 6/2008 |
| CN | 102815314 | A | 12/2012 |
| CN | 202743123 | U | 2/2013 |
| CN | 103612638 | A | 3/2014 |
| CN | 203543968 | U | 4/2014 |
| CN | 203805894 | U | 9/2014 |
| CN | 204037562 | U | 12/2014 |
| CN | 204055789 | U | 12/2014 |
| CN | 104309614 | A | 1/2015 |
| CN | 104325985 | A | 2/2015 |
| CN | 204136994 | U | 2/2015 |
| CN | 204368151 | U | 6/2015 |
| CN | 105151056 | A | 12/2015 |
| DE | 410193 | C | 12/1925 |
| DE | 519637 | C | 3/1931 |
| DE | 1605012 | A1 | 2/1971 |
| GB | 191410787 | A | 9/1915 |
| RU | 2268180 | C2 | 1/2006 |
| RU | 149541 | U1 | 1/2015 |
| SU | 1650501 | A1 | 5/1991 |
| WO | WO 2014/128448 | A1 | 8/2014 |

* cited by examiner

WAGON AND VEHICLE BODY ASSEMBLY THEREOF

This application is the national phase of International Application No. PCT/CN2016/096576, titled "WAGON AND VEHICLE BODY ASSEMBLY THEROF", filed on Aug. 24, 2016, which claims the benefit of priority to Chinese Patent Application No. 201510651438.0 titled "FREIGHT TRAIN AND CAR BODY ASSEMBLY THEREOF", filed with the Chinese State Intellectual Property Office on Oct. 10, 2015, the entire disclosures of which are incorporated herein by reference.

FIELD

The present application relates to the field of hopper cars, and particularly to a freight train and a car body assembly thereof.

BACKGROUND

A railway hopper car is a railway wagon having a hopper arranged at a lower part of its car body. Goods are loaded from an upper side, and when unloading the goods, a hopper bottom door is opened by manpower or wind, and the goods are unloaded automatically under their own gravity without using manpower and material resources. The railway hopper car is mainly used for transporting ores, cements, coals and other bulk goods, and is widely used in economic fields such as power plants, ports, coal preparation and steel.

Reference is made to FIG. 1, which is a schematic view showing the partial structure of a typical railway hopper car in the conventional technology.

The railway hopper car mainly includes an underframe and a car body 4' arranged on the underframe. The car body 4' is a cavity structure defined mainly by two side walls and two end walls 41' and for loading goods, and a discharge opening 5' is provided at a lower part of the car body 4'. The underframe mainly includes two bogies 3' arranged along the car body 4' and a side sill supported on the bogie 3', and the car body 4' is supported between the two bogies 3'. In order to smoothly unload the goods inside the car body 4' from the discharge opening 5' to the outside, each of the end walls 41' at two sides is generally provided with an inclined segment arranged at a predetermined angle with respect to a horizontal plane, and the angle of the inclined segment is greater than the angle of repose of the goods.

A brake device 2', a drive device and relevant components are generally provided on the bogie 3', thus a sufficient space is required to be reserved between the end wall 41' of the car body 4' and an upper surface of the bogie 3'. Thus, it is apparent from FIG. 1, in the conventional technology, the goods are generally loaded between the two bogies 3', that is, a middle part of the vehicle.

Apparently, a space above an end, where a coupler buffer device 1' is mounted, of the bogie 3' cannot be fully utilized, thus, the capacity of the railway hopper car is relatively small under a rated car length, which greatly reduces the transport efficiency of the car and increases the transport cost of the goods.

Therefore, an urgent technical issue to be addressed by the person skilled in the art is to improve the car body 4' of the railway hopper car in the conventional technology, to increase the capacity of the car body 4', to thereby improving the transport efficiency of the vehicle and reducing the transport cost of the goods.

SUMMARY

An object of the present application is to provide a freight train and a car body assembly of the freight train. The car body assembly fully utilizes a longitudinal space of the freight train and greatly increases the capacity of the freight train, thereby improving the carrying capacity of the freight train and reducing the transport cost of goods.

In order to address the above technical issues, a car body assembly of a freight train is provided according to the present application, which includes at least two bogies, an underframe and a car body both supported on the two bogies, the car body includes a middle car body, and a discharge opening of the middle car body is arranged between the two bogies, and at least one end of the middle car body is further provided with an end car body, and a predetermined space is defined above the respective bogie by adjacent end walls of the middle car body and the end car body.

Compared with the conventional technology which only including the middle car body, the car body herein further includes the end car body, and the bogie is arranged below the adjacent end walls of the middle car body and the end car body, which, on the premise of not interfering with the installation of other components on the bogie, makes full use of a longitudinal space of the freight train, greatly increases the capacity of the railway train, thereby enhancing the carrying capacity of the freight train and reducing the transport cost of the goods.

Optionally, a bottom of the end car body is further provided with a discharge opening, the discharge opening is arranged at an outside of the respective bogie, and the discharge opening is equipped with an end bottom door mechanism.

Optional, two side walls of the car body are each an arc-shaped structure protruding outward.

Optionally, the number of the end car body is two, and the two end car bodies are arranged at two ends of the middle car body respectively, outer end walls of the two end car bodies form two end walls of the car body, the car body assembly further includes a top cover, and the top cover covers a top opening enclosed by side walls and the outer end walls of the car body.

Optionally, a bottom of the end car body is further provided with a ridge structure extending longitudinally, the ridge structure protrudes upward to form an inverted V-shaped structure, and a first discharge opening and a second discharge opening which are in communication with an inner cavity of the end car body are respectively provided at two side of the ridge structure.

Optionally, lower ends of two side walls of the ridge structure fit close to the underframe, and the two side walls of the ridge structure and an upper surface of the underframe form a communication passage extending through a bottom portion of the end car body, and the predetermined space is in communication with an outer end wall of the end car body via the communication passage.

Optionally, a longitudinal center sill is arranged on the underframe at a position corresponding to the ridge structure, the two side walls of the ridge structure abut against the center sill and are supported by the center sill, and the two side walls of the ridge structure and the center sill form the communication passage.

Optionally, the adjacent end walls of the middle car body and the end car body are respectively a first flat plate of the middle car body and a second flat plate of the end car body, and the first flat plate and the second flat plate form a triangular space with an opening facing downwards.

Optionally, the number of the end car body is two, and the two end car bodies are respectively arranged at two ends of the middle car body, outer end walls of the two end car bodies form two end walls of the car body, and the two outer end walls are flat plates arranged vertically.

Optionally, the car body assembly further includes a top cover opening and closing drive mechanism and two sub-top covers of the car body assembly, the two sub-top covers are arranged symmetrically in a left-right direction with respect to a traveling direction of the train, and the top cover opening and closing drive mechanism is configured to drive the two sub-top covers to oppositely rotate with respect to the car body to be joined or separated, the top cover opening and closing drive mechanism includes a cylinder and two rocker arms arranged corresponding to the two sub-top covers respectively and fixedly connected to the two sub-top covers respectively, and the two rocker arms are each hinged to an end wall of the car body, and are hinged to each other by a connecting rod, and the cylinder is configured to drive one of the two rocker arms to rotate about a hinge point of the corresponding rocker arm and the end wall, and in a case that a loading opening of the car body is in a closed state, the two rocker arms are in parallel with each other; a hinge point, where one of the two rocker arms is hinged to the connecting rod, is located above a connecting line between hinge points where the two rocker arms are hinged to the end wall; and a hinge point, where the other one of the two rocker arms is hinged to the connecting rod, is located below the connecting line between the hinge points where the two rocker arms are hinged to the end wall.

Optionally, a distance from the hinge point of the end wall and one of the two rocker arms to the hinge point of the connecting rod and the respective rocker arm is equal to a distance from the hinge point of the end wall and the other one of the two rocker arms to the hinge point of the connecting rod and the respective rocker arm, and the distances are less than a length of the connecting line between the hinge points where the two rocker arms are hinged to the end walls.

Optionally, each of the two rocker arms includes a main arm and an auxiliary arm, an angle formed between the main arm and the auxiliary arm, after being fixedly connected, of one of the two rocker arms is greater than an angle formed between the main arm and the auxiliary arm, after being fixedly connected, of the other one of the two rocker arms; and a top end of the main arm is fixedly connected to the respective sub-top cover, and a bottom end of the main arm is hinged to the end wall, and the auxiliary arms of the two rocker arms are hinged by the connecting rod.

Optionally, the rocker arm further includes a transverse arm and a reinforcement arm which are fixedly connected to the main arm to form a triangular frame structure.

Optionally, each of the sub-top covers includes a front end plate, a top plate and a rear end plate successively connected, the front end plate and the rear end plate are respectively located at an outside of the respective end walls, and the top plate is a circular arc-shaped plate concentric with the end walls, and a hinge point of the rocker arm and the respective end wall is a center of the top plate.

Optionally, the car body assembly further includes a locking mechanism configured to restrict the two sub-top covers from oppositely rotating in a state that the two sub-top covers are joined, the locking mechanism includes a lock seat, a rotating shaft, a lock hook, a push rod, a torsion spring and a locking member, the lock seat is fixedly connected to one of the two rocker arms, the lock seat is rotatably connected to the piston rod and is slidable with respect to the piston rod in a telescoping direction of the piston rod, the rotating shaft is hinged to the lock seat and fixedly connected to both the lock hook and the push rod; the torsion spring is sleeved on the rotating shaft, and has one torsional end fixedly connected to the lock seat and another torsional end fixedly connected to the push rod, and the locking member is fixedly connected to the end wall; and in a locked state, the lock hook abuts against a stop surface of the locking member under the action of a torsional force of the torsion spring, and the piston rod extends with respect to the lock seat to push the push rod to overcome the torsional force of the torsion spring, to drive the lock hook to rotate to be disengaged from the locking member, to allow the locking mechanism to be switched into an unlocking state.

Optionally, the piston rod and the lock seat are connected by a connecting plate, the connecting plate is fixedly connected to the piston rod, the connecting plate and the lock seat are rotatable with respect to each other and are slidable with respect to each other along an elongated hole extending in the telescoping direction of the piston rod, and the elongated hole is provided in the connecting plate or the lock seat.

Optionally, the lock seat includes a first plate member, a second plate member and a third plate member, the first plate member includes a first plate body and a second plate body which are bent into a right angle, the second plate member is perpendicular fixedly connected to the first plate body, and the third plate member is perpendicular fixedly connected to the second plate member, and the rocker arm is fixedly connected to both the second plate member and the second plate body, and the rotating shaft is located between the first plate body and the third plate member and is hinged to both the first plate body and the third plate member.

Optionally, the car body assembly further includes an end wall, the end wall includes a main body plate, an outer wall surface of a lower part of the main body plate is flush with a front end surface of the underframe of the car body assembly of the freight train, and an upper part of the main body plate is inwardly concaved with respect to the lower part of the main body plate to form a recess, and the recess is configured to accommodate a top cover opening and closing drive mechanism of the car body assembly of the freight train.

Optionally, in a vertical direction, the main body plate includes an upper inclined segment inclined inwards from an upper end portion of the main body plate and extending downwards, an upper vertical segment extending downwards from the upper inclined segment, a lower inclined segment inclined outwards from the upper vertical segment and extending downwards, and a lower vertical segment extending downwards from the lower inclined segment which are arranged successively, and an outer wall surface of the lower vertical segment is flush with the front end surface of the underframe, and the recess is formed by the upper inclined segment, the upper vertical segment and the lower inclined segment.

Optionally, a longitudinal length from the upper inclined segment to an outer wall surface of the upper vertical segment is greater than or equal to a longitudinal length from the upper inclined segment to a front end surface of the top cover opening and closing drive mechanism.

Optionally, a transverse reinforcement rib extending transversely is provided on an outer wall surface of the main body plate, and the transverse reinforcement rib is located at a joint between the upper vertical segment and the lower inclined segment, and/or, the transverse reinforcement rib is located at a joint between the lower inclined segment and the lower vertical segment.

Optionally, the main body plate has a plurality of vertical reinforcement ribs arranged successively at intervals in the transverse direction, and each of the vertical reinforcement ribs extends vertically along the outer wall surface of the main body plate.

Optionally, the car body assembly includes an end bottom door opening and closing mechanism configured to open and close an end bottom door of a hopper car, and, the end bottom door opening and closing mechanism includes:

a door opening arm configured to open the end bottom door;

a door closing arm configured to close the end bottom door;

a connecting shaft having two ends respectively connect the door opening arm and the door closing arm, wherein the door opening arm and the door closing arm drive the connecting shaft to rotate; and two connecting levers respectively connected to a side corresponding to the door opening arm and a side corresponding to the door closing arm, wherein each of the connecting levers includes a first bent lever and a second bent lever fixedly connected and are at a certain angle with respect to each other, one of the first bent lever and the second bent lever is hinged to the end bottom door, and the other one of the first bent lever and the second bent lever is hinged to the door opening arm or the door closing arm at a corresponding side, and rotation axes of hinge connection of the first bent lever and the second bent lever are all in parallel with the connecting shaft.

Optionally the door opening arm includes a door opening arm shaft and a door opening arm head perpendicularly connected to one end of the door opening arm shaft, the door closing arm includes a door closing arm shaft and a door closing arm head perpendicularly connected to one end of the door closing arm shaft; a middle part of each of the door opening arm shaft and the door closing arm shaft is provided with a fixedly connection hole configured to fixedly connect the door opening arm shaft or the door closing arm shaft to the connecting shaft, and the connecting levers are hinged to another end of the door opening arm shaft and another end of the door closing arm shaft at the corresponding sides respectively.

Optionally, the angle formed by the first bent lever and the second bent lever is an obtuse angle.

Optionally, a predetermined distance is provided between the center line of the connecting shaft and a connection line of the two hinge points of the connecting lever.

Optionally, the end bottom door opening and closing mechanism further includes an adjustment assembly configured to adjust the predetermined distance to limit the predetermined distance within a certain range.

Optionally, the adjustment assembly includes:

an adjusting rod, and a limit stop fixed to the connecting shaft, wherein the adjusting rod has one end fixed to the car body and has another end connected to the limit stop, and is configured to adjust a connection distance between the connecting shaft and the car body, and an elastic member fixedly connected to an end hopper bin of the hopper car, wherein the elastic member in a preloaded state abuts against an inner wall of the end bottom door, to define a distance between the end bottom door and the end hopper bin.

Optionally, the adjustment assembly further includes a U-shaped frame and a bearing rod, each of two side walls of the U-shaped frame is provided with a guide hole, and the bearing rod passes through the guide holes and is movable along the guide holes, the elastic member is a spring, a bottom of the U-shaped frame is fixed to the end hopper bin, and the bearing rod has a protruding end fixed to the inner wall of the end bottom door, and the spring sleeved on the bearing rod has one end fixed to an inner wall of the U-shaped frame and another end fixed to the bearing rod.

Further, a freight train is also provided according to the present application, which includes a locomotive and at least one car body assembly, and the car body assembly is the car body assembly according to any one of the above aspects.

Since the freight train according to the present application includes the car body assembly having the above technical effects, the freight train also has the above-described beneficial effects of the car body assembly.

Figure 1:
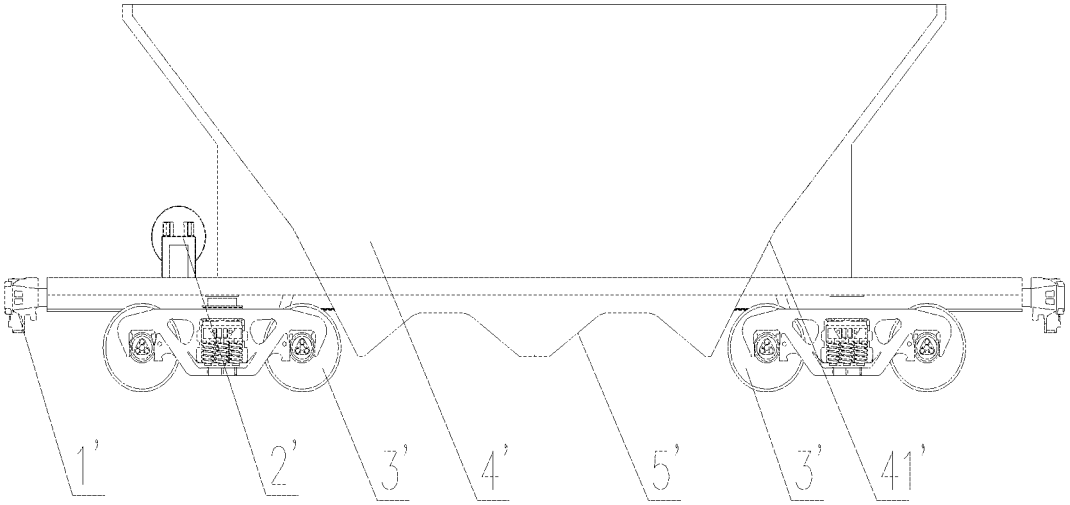
FIG. 1 is a schematic view showing a partial structure of a typical railway hopper car in the conventional technology.

The one-to-one correspondences between component names and reference numerals in FIG. 1 are as follows:

| | | | |
|---|---|---|---|
| 1' | coupler buffer device, | 2' | brake device, |
| 3' | bogie, | 4' | car body, |
| 5' | discharge opening, | 41' | end wall. |

The one-to-one correspondences between component names and reference numerals in FIGS. 2 to 5 are as follows:

| | | | |
|---|---|---|---|
| 11 | bogie, | 12 | underframe, |
| 121 | center sill, | 13 | car body, |
| 3a | predetermined space, | 130 | side wall, |
| 131 | middle car body, | 1311 | first flat plate, |
| 132 | end car body, | 1321 | second flat plate, |
| 132a | first discharge opening, | 132b | second discharge opening, |
| 132c | communication passage, | 1321 | inner end wall, |
| 1322 | outer end wall, | 133 | ridge structure, |
| 134 | top cover, | 141 | middle bottom door, |
| 142 | bottom door opening and closing connecting rod, | 143 | end bottom door, |
| 144 | bottom door opening and closing connecting rod, | 15 | brake device. |

The one-to-one correspondences between component names and reference numerals in FIGS. 5 to 11 are as follows:

| | | | |
|---|---|---|---|
| 210 | left sub-top cover, | 220 | right sub-top cover, |
| 230 | len side wall, | 240 | right side wall, |
| 250 | cylinder, | 251 | piston rod, |
| 260 | driving rocker arm, | 261 | driving main arm, |
| 262 | driving auxiliary arm, | 263 | transverse arm, |
| 264 | reinforcement arm, | 270 | driven rocker arm, |
| 271 | driven main arm, | 272 | driven auxiliary arm, |
| 280 | connecting rod, | 290 | lock seat, |
| 2901 | first plate body, | 2902 | second plate body, |
| 2903 | second plate member, | 2904 | third plate member, |
| 291 | lock hook, | 292 | rotating shaft, |
| 293 | torsion spring, | 294 | push rod, |
| 295 | connecting plate, | 296 | locking member, |
| 2961 | vertical plate, | 2962 | transverse plate, |
| 2963 | reinforcement plate. | | |

Figure 12:
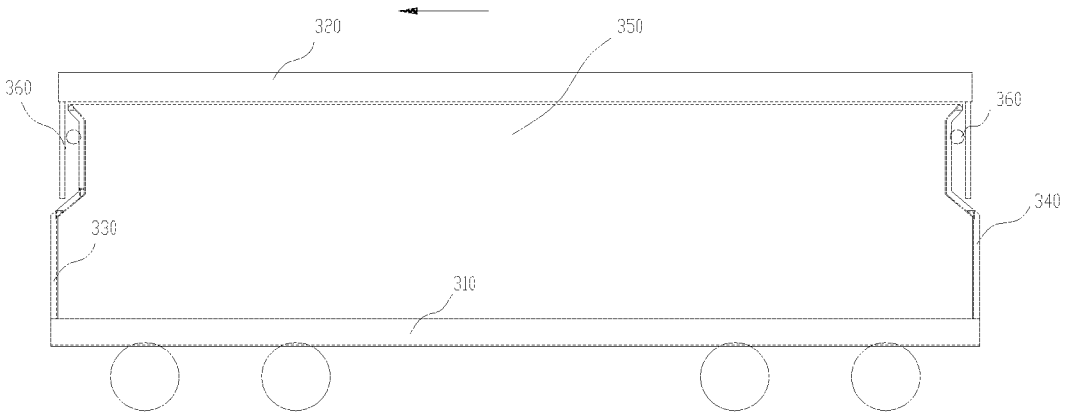
FIG. 12 is a schematic view showing the longitudinal structure of a car body assembly of a freight train according to the present application.
Figure 13:
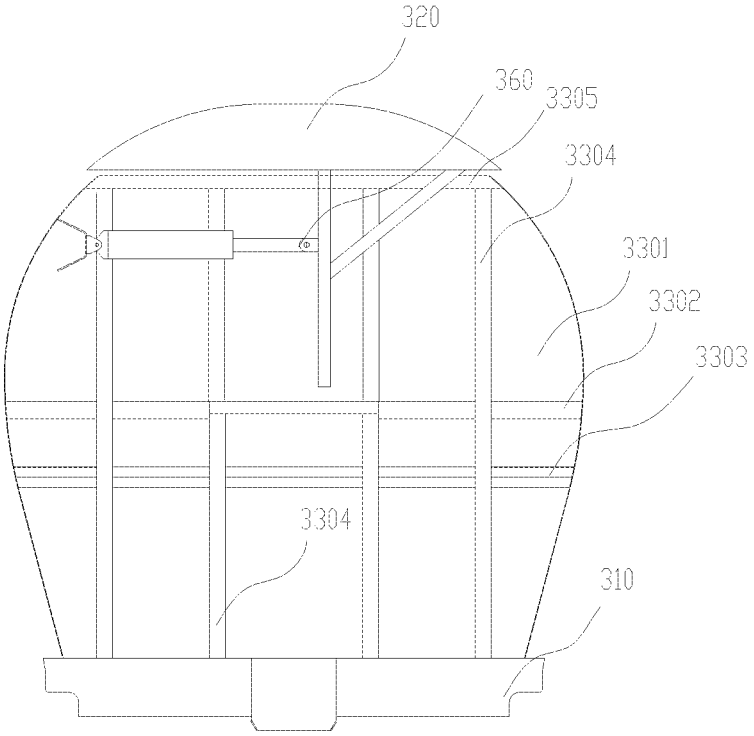
FIG. 13 is a schematic view showing the transverse structure of the car body assembly of the freight train in FIG. 12.
Figure 14:
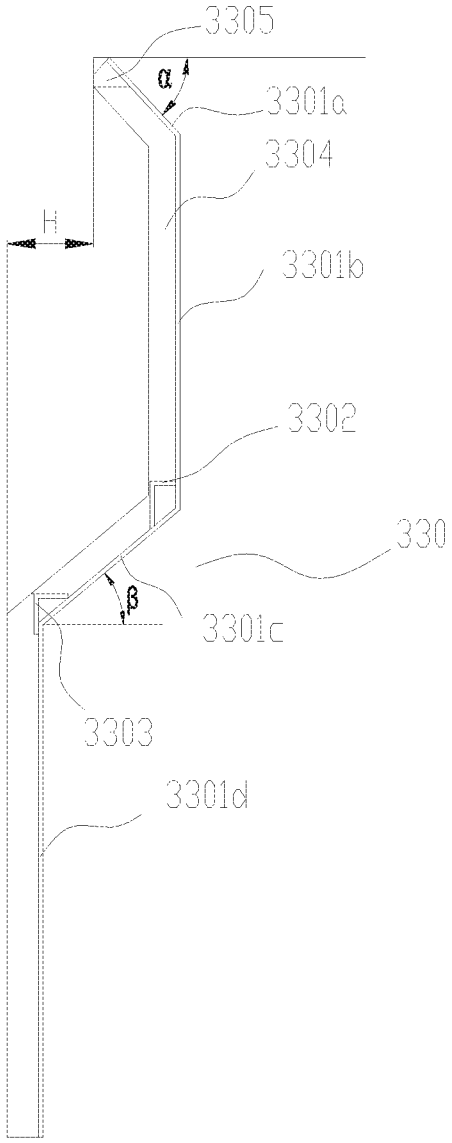
FIG. 14 is a schematic view showing the structure of a front end wall in FIG. 12.

The one-to-one correspondences between component names and reference numerals in FIGS. 12 to 14 are as follows:

| | | | |
|---|---|---|---|
| 310 | underframe, | 320 | top cover, |
| 330 | front end wall: | 3301 | main body plate, |
| 3301a | upper inclined segment, | 3301b | upper vertical segment, |
| 3301c | lower inclined segment, | 3301d | lower vertical segment, |
| 3302 | upper transverse reinforcement rib, | 3303 | lower transverse reinforcement rib, |
| 3304 | vertical reinforcement rib, | 3305 | upper end sill, |

-continued

| | | | |
|---|---|---|---|
| 340 | rear end wall, | 350 | left side wall, |
| 360 | top cover opening and closing mechanism. | | |

The one-to-one correspondences between component names and reference numerals in FIGS. 15 to 18 are as follows:

| | | | |
|---|---|---|---|
| 10 | end bottom door opening and losing mechanism, | | |
| 411 | door opening arm, | 4111 | door opening arm shaft, |
| 4112 | door opening arm head, | 412 | door closing arm, |
| 4121 | door closing arm shaft, | 4122 | door closing arm head, |
| 413 | connecting shaft, | 414 | connecting lever, |
| 4141 | first bent lever, | 4142 | second bent lever, |
| 415 | adjusting rod, | 416 | limit stop, |
| 417 | U-shaped frame, | 418 | bearing rod, |
| 420 | end bottom door, | | |
| 430 | middle bottom door opening and closing mechanism, | | |
| 440 | middle bottom door, | 450 | predetermined distance, |
| 460 | bogie, | 470 | car body, |
| 480 | end hopper bin. | | |

DETAILED DESCRIPTION

The core of the present application is to provide a freight train and a car body assembly of the freight train. The car body assembly folly utilizes a longitudinal space of the freight train and greatly increases the capacity of the freight train, and thus improving the carrying capacity of the freight train and reducing the transport cost of goods.

The present application will be further described in detail hereinafter with reference to the drawings and specific examples in order to enable the person skilled in the art to better understand the technical solution of the present application.

Figure 2:
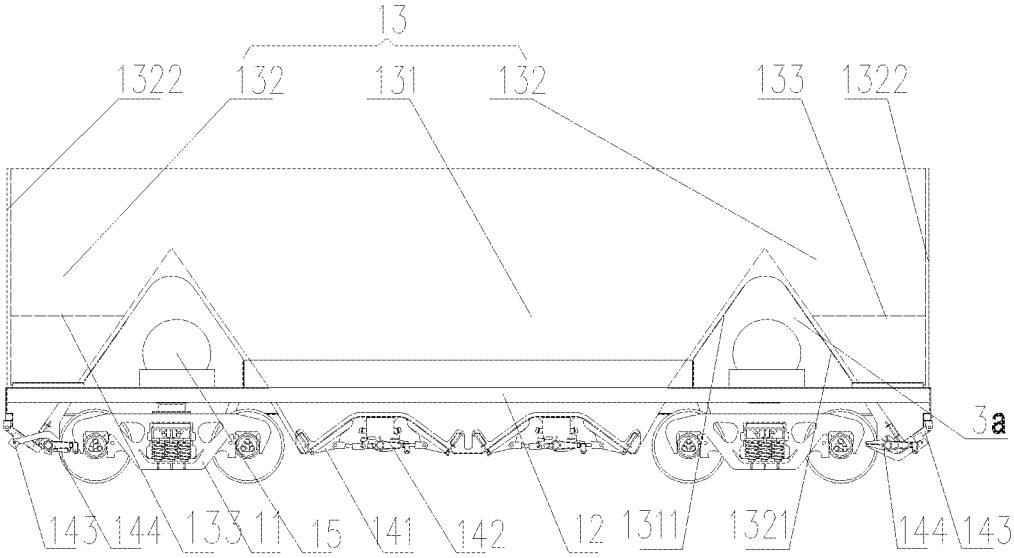
FIG. 2 is a schematic view showing the structure of a car body assembly of a freight train according to the present application.
Figure 3:
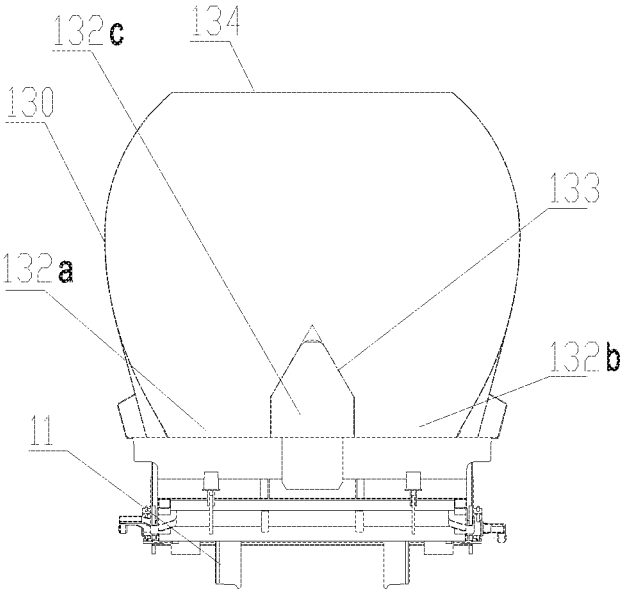
FIG. 3 is a schematic side view of the car body assembly shown in FIG. 2.
Figure 4:
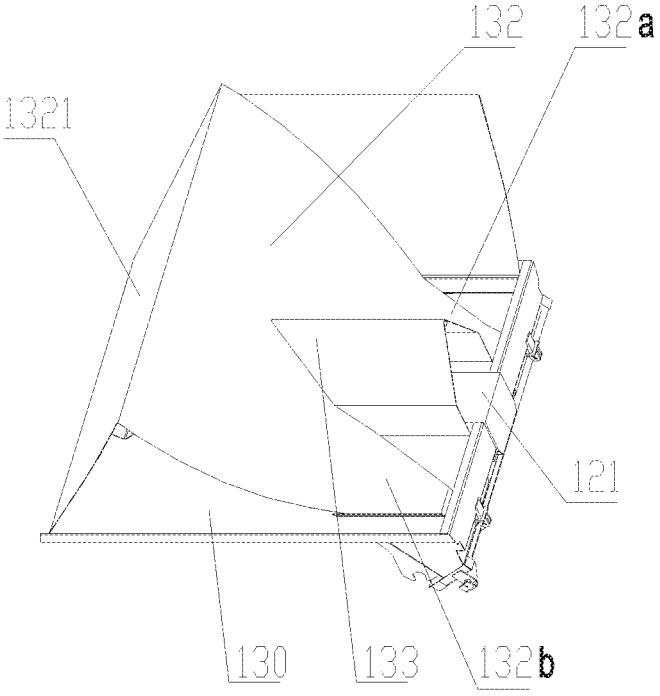
FIG. 4 is a schematic view showing the structure of an end car body according to the present application.

Reference may be made to FIGS. 2 to 4, FIG. 2 is a schematic view showing the structure of a car body assembly of a freight train according to the present application; FIG. 3 is a schematic side view of the car body assembly shown in FIG. 2; and FIG. 4 is a schematic view showing the structure of an end car body according to the present application.

A car body assembly of a freight train is provided according to the present application. The car body assembly includes at least two bogies 11. For a car body assembly having two bogies 11, the two bogies 11 are generally arranged at two ends of the car body assembly in a length direction of the car body, and an outer end of each bogie 11 is generally provided with a coupler buffer device, and the coupler buffer device is configured to connect adjacent car body assemblies or connecting a car body assembly to a locomotive. The bogie 11 is generally provided with a brake device 15 for braking the wheels, and the brake device 15 may be an air brake 15. In some cases, the bogie 11 is further provided with a power device, and the power device is configured to provide power for the operation of the car.

An underframe 12 and a car body 13 are generally supported on the bogie 11. The underframe 12 is generally composed of two side sills arranged longitudinally along the car body, several transverse beams and several end sills arranged between the two side sills and the like. The longitudinal direction of the car body herein refers to a length direction of the car body 13. The arrangement of components of the underframe 12 can be set according to the use intensity of the freight train and for ease installation of other parts.

The car body 13 herein includes a middle car body 131 and an end car body 132. A lower end of the middle car body 131 is arranged between two bogies 11, and a discharge opening at the bottom of the middle car body 131 is arranged between the two bogies 11. At least one end of the middle car body 131 is further provided with the end car body 132, and each of the middle car body 131 and the end car body 132 is an inner cavity having an up ward opening and is used for loading goods. The inner cavity of the middle car body 131 and the inner cavity of the end car body 132 may be in communication with each other or not in communication with each other, and it is preferably that the inner cavity of the middle car body 131 and the inner cavity of the end car body 132 are in communication with each other. The goods of the middle car body 131 is loaded from an opening at an upper end of the middle car body 131 and can be discharged from the discharge opening at the bottom of the middle car body 131. An upper end of the end car body 132 may also have an opening, and the goods in the end car body 132 may be discharged from the discharge opening of the middle car body 131; alternatively a specialized end discharge opening may be provided at the bottom of the end car body 132, to discharge the goods inside the end car body 132. An embodiment of providing the discharge opening at the bottom of the end car body 132 will be described in detail below.

It should be noted that, in order to meet the use requirements, that is, the discharge opening is in a closed state when loading goods and is in an opened state when discharging goods, providing a bottom door mechanism at the position of the discharge opening is an essential technical means. The opening and closing of the bottom door mechanism can be achieved manually, and can also be achieved through wind power, of course, it can also be performed by impacting a specialized mechanism arranged on the ground. As shown in FIG. 2, the middle car body 131 has a middle bottom door 141 and a bottom door opening and closing connecting rod 142 for opening and closing the middle bottom door 141, and the end car body 132 has an end bottom door 143 and a bottom door opening and closing connecting rod 144 for opening and closing the end bottom door 143.

In addition, an end wall of the middle car body 131 and an end wall of the end car body 132 that is adjacent to the end wall of the middle car body 131 herein define a predetermined space 3*a* above the bogie 11. That is, a portion, at a position corresponding to the bogie 11, of the end wall of the car body 13 protrudes upward, and the predetermined space 3*a* is provided between the car body 13 and the bogie 11. In this way, the brake device 15 for braking the wheels and other components of the bogie 11 can be installed inside the predetermined space 3*a* without interfering with the installation and operation of the components on the bogie 11.

Compared with the conventional technology only having the middle car body 131, the car body 13 according to the present application further includes an end car body 132, and the bogie 11 is placed under the adjacent end walls of the middle car body 131 and the end car body 132, which makes full use of the longitudinal space of the freight trains and greatly increases the capacity of the freight train on the premise of not interfering with the installation of other components on the bogie 11, thereby improving the carrying capacity of the rail freight car and reducing the transport cost of goods.

In an embodiment, the bottom of the end car body 132 is also provided with a discharge opening. The discharge opening is arranged outside the corresponding bogie 11. It should be noted that, the position directed towards the middle of the two bogies 11 is defined as inner, and correspondingly, and the position directed towards the coupler buffer device is defined as outer. The end car body 132 provided with the discharge opening may allow the materials to be discharged from the end of the freight train and increase the material discharging speed. For the bottom door mechanism mounted at the end car body, reference may be made to the bottom door mechanism at the discharge opening of the middle car body 131. The bottom door mechanism includes the above middle bottom door 141 and the bottom door opening and closing connecting rod 142. Apparently, the bottom door mechanism of the end car body 132 may also be different from the bottom door mechanism of the middle car body 131.

Two side walls 130 of the above middle car body 131 and the end car body 132 may each have an arc-shaped structure protruding outwards, and in order to further protect the goods from being adversely affected by the external environment, a top cover 134 may further be provided at the upper opening of the car body 13. The periphery of the top cover 134 is engaged with the side walls 130 and the end walls of the car body. In this case, an outer end wall 1322 of the end car body 132 is the end wall of the car body, as shown in FIG. 2, the end wall (the outer end wall 1322) may be in the form of an upright plate, and the top cover 134 may also be a horizontal plate, namely, the cross section of an integrated body of the top cover 134, the side walls 130, the end walls (the outer end walls 1322), and the underframe 12 has a drum-shaped outer profile.

In an embodiment, the bottom of the end car body 132 may be further provided with a longitudinally extending ridge structure 133. The ridge structure 133 protrudes upwards and has an approximately inverted V-shaped structure, i.e. the ridge structure 133 has two side walls, and the two side walls form a recess with an opening facing downwards. It should be appreciated by the person skilled in the art that the V shape described herein is not exactly the same as the shape of the letter V, but, is approximately similar to it. Two discharge openings in communication with the inner cavity of the end car body 132 are respectively provided at two sides of the ridge structures 133, that is, the goods in the inner cavity of the end car body 132 is divided into two streams when passing by the ridge structure 133 in the process of being discharged downward, and the two streams of goods are discharged to the outside respectively via a first discharge opening 132*a* and a second discharge opening 132*b* at the two sides.

The brake device 15 on the bogie 11 is generally required to be connected to the pipeline on an adjacent bogie 11, and for facilitating the arrangement of pipelines, the following arrangement is further made herein.

Further, end portions of two side walls of the ridge structure 133 in the above-described embodiments fit close to the underframe 12, and the two side walls of the ridge structure 133 and the upper surface of the underframe 12 form a communication passage 132*c* extending through the bottom of the end car body 132. The predetermined space 3*a* surrounded by the bottom wall and the bogie 11 is in communication with an outer end wall of the end car body 132 adjacent to the predetermined space 3*a* via the communication passage 132*c*. In this way, the pipeline connected to the brake device 15 can pass through the end car body 132 at the position below the ridge structure 133, and then be connected to the corresponding parts on a bogie 11 at the other side of the end car body 132. In this way, the arrangement of the pipelines of the car body is further optimized.

On the basis of the above-described embodiments, a center sill 121 may further be provided on the underframe 12 at a position corresponding to the ridge structure 133, and the two side walls of the ridge structure 133 are supported against the center sill 121, that is, the two side walls of the ridge structure may be supported on an upper surface of the center sill 121, or may be supported on side walls of the center sill 2. As shown in FIG. 4, the two side walls of the ridge structure 133 and the center sill 121 define the above communication passage 132*c*. In this way, the center sill 121 can support the pipeline, and the two side walls of the ridge structure have a position-limiting effect on the pipeline in a certain degree.

In addition, the pipeline is located in the circumferentially closed space surrounded by the ridge structure 133 and the center sill 121, which may facilitate protecting the pipeline from being adversely affected by the external environment and improve the service life of the pipeline.

The adjacent end walls of the middle car body 131 and the end car body 132 are respectively a first flat plate 1311 and a second flat plate 1321, and the first flat plate 1311 and the second flat plate 1321 define a triangular space with an opening facing downwards. The shape of the triangular space is shown in FIG. 1. An upper end of the first flat plate 1311 and an upper end of the second flat plate 1321 are hermetically connected to ensure the reliability of the sealing between the end car body 132 and the middle car body 131, and a lower end of the first flat plate 1311 and a lower end of the second flat plate 1321 respectively pass through the bogie 11 and extend to corresponding discharge openings.

In the longitudinal direction of the car body, an upper end of the triangular space has a relatively small dimension and a lower end portion of the triangular space has a relatively large dimension, that is, from the top to the bottom, the closer a portion of the triangular space to the bogie 11, the greater the size of the portion. In this way, on the premise of meeting the requirement for arrangement space of the brake device 15, the connection between the middle car body 131 and the end car body 132 can minimize the occupancy of the upper space of the bogie 11 as much as possible.

Of course, the shape of the predetermined space 3*a* formed by adjacent ends of the middle car body 131 and the end car body 132 is not limited to the description herein, and may also be arc-shaped or squared passage or the like.

Further, on the basis of the above-described embodiments, a top cover opening and closing drive mechanism of a car body of a freight train is further provided according to the present application, to address the technical issues of cylinder blockage and a too small opening degree of the loading opening of the car body of the freight train. The present application is further described in detail with reference to FIGS. 5 to 11 and the embodiments for enabling the person skilled in the art to better understand the technical solution of the present application.

It is to be noted that, in describing the top cover opening and closing drive mechanism, the orientations such as the front and rear, up and down, left and right described below are all defined by taking the railway vehicle as a reference, the direction in parallel with the traveling direction of the railway vehicle is defined as a longitudinal direction. In the longitudinal direction, the direction in which the traveling direction is directed is front, and the direction opposite to the traveling direction is rear. In a plane in parallel with a running rail surface of the railway vehicle, the direction perpendicular to the longitudinal direction is a transverse direction, and in the transverse direction, viewed in the traveling direction, the direction at the left side is left, and the direction at the right is right. The direction perpendicular to the running rail surface of the railway vehicle is a vertical direction, and in the vertical direction, a direction towards the rail surface is down, and a direction away from the rail surface is up. In addition, the arrow " " in the drawing of the specification represents the traveling direction of the freight train.

The car body of the freight train generally includes two sets of the top cover opening and closing drive mechanisms. The underframe, the front end wall, the rear end wall, the left side wall and the right side wall are fixedly connected by welding, riveting, screwing, or the like, to form a car body with a loading opening facing upwards. The top cover includes a left sub-top cover and a right sub-top cover. The two sets of top cover opening and closing drive mechanisms are respectively arranged at the front end wall and the rear end wall, and are configured to respectively drive the left sub-top cover and the right sub-top cover to rotate in opposite directions, to control the opening and closing of the loading opening of the car body.

It is to be noted that, in addition to the top cover opening and closing drive mechanism, the specific structures and connection relationships of the underframe, the front and rear end walls, and the left and right side walls of the car body of the freight train are basically the same as those of the conventional technology, and can be implemented completely by the person skilled in the art based on the conventional technology. Therefore, only the specific structure and the opening and closing principle of the top cover opening and closing drive mechanism, that is, the innovation point of the car body of the freight train, are described hereinafter with reference to the drawings of the specification. Of course, on the premise of meeting the requirements for driving the two sub-top covers to be joined or separated, the car body of the freight train may also include only one set of the top cover opening and closing drive mechanism.

In addition, the two sets of the top cover opening and closing drive mechanisms are arranged symmetrically in a front-rear direction with respect to the left side wall and the right side wall and have identical structures, and based on the specific structure and driving principle of one set of the top cover opening and closing drive mechanism, the person skilled in the art can directly and undoubtedly obtain the specific structure and driving principle of another set of the top cover opening and closing drive mechanism. Thus, the specific structure and the opening and closing principle of the top cover opening and closing drive mechanism are described in detail, hereinafter with reference to the drawings by taking the top cover opening and closing drive mechanism arranged at the front end wall as an example.

Figure 5:
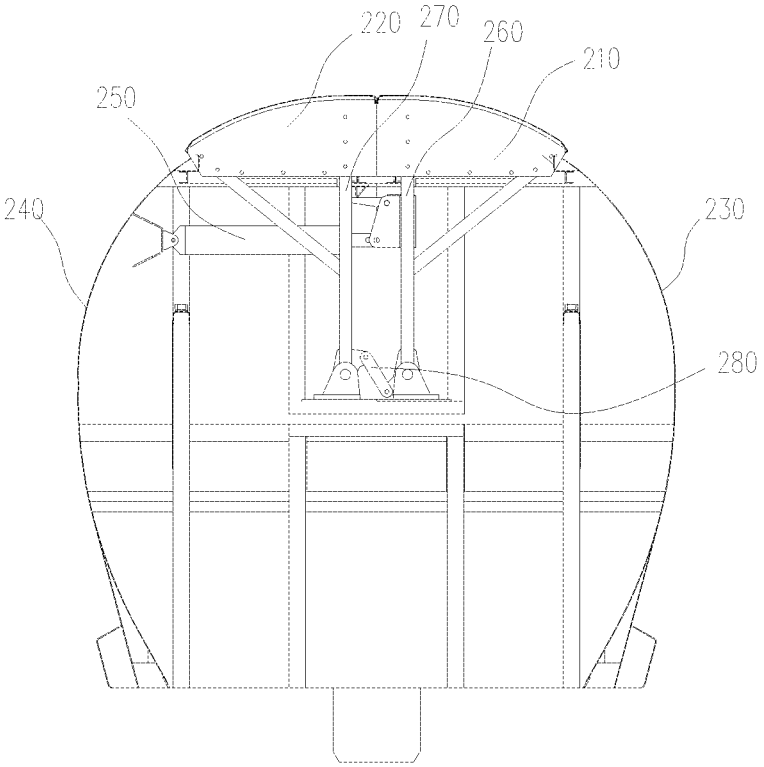
FIG. 5 is a schematic view showing the transverse structure of a car body assembly of a freight train according to the present application with a loading opening in a closed state.
Figure 6:
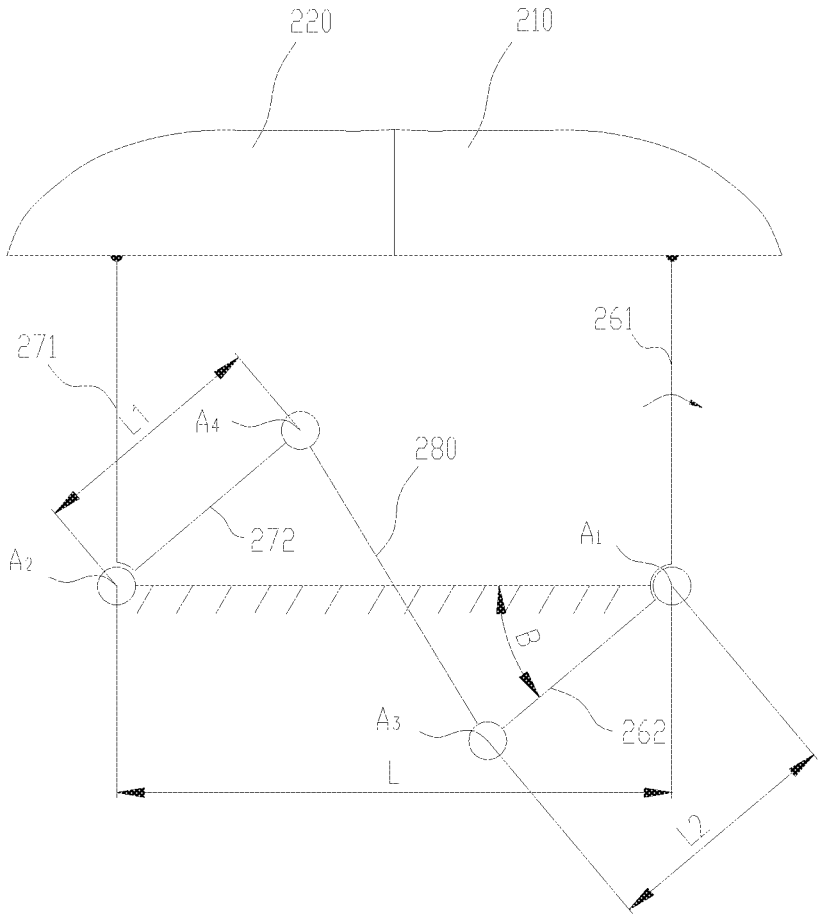
FIG. 6 is a schematic view showing the mechanism principle of FIG. 5.
Figure 7:
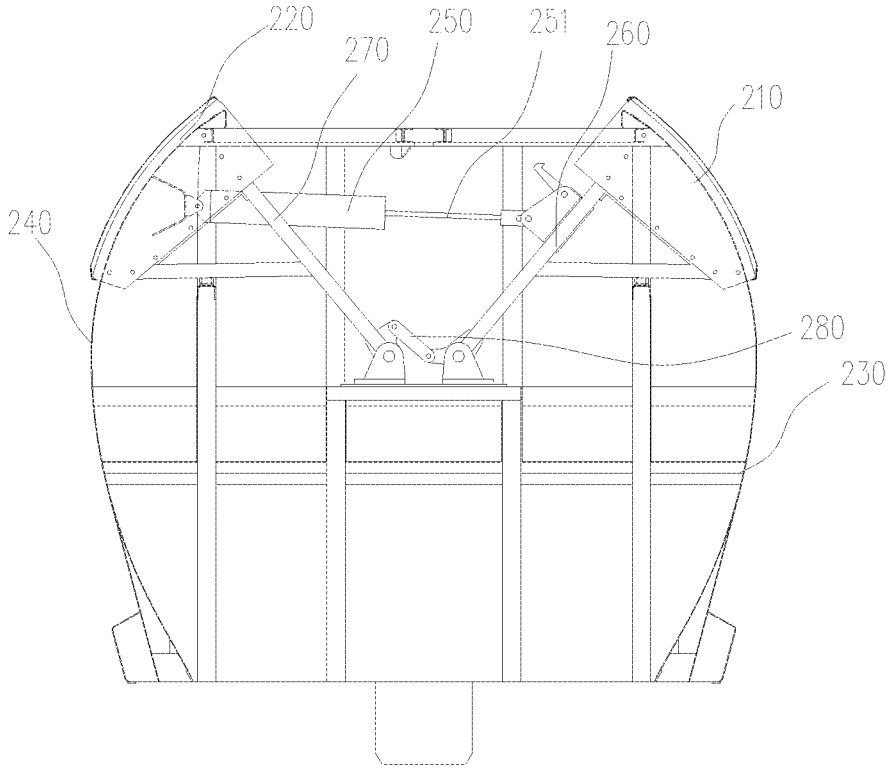
FIG. 7 is a schematic view showing the transverse structure of the car body assembly of the freight train according to the present application with the loading opening in an opened state.
Figure 8:
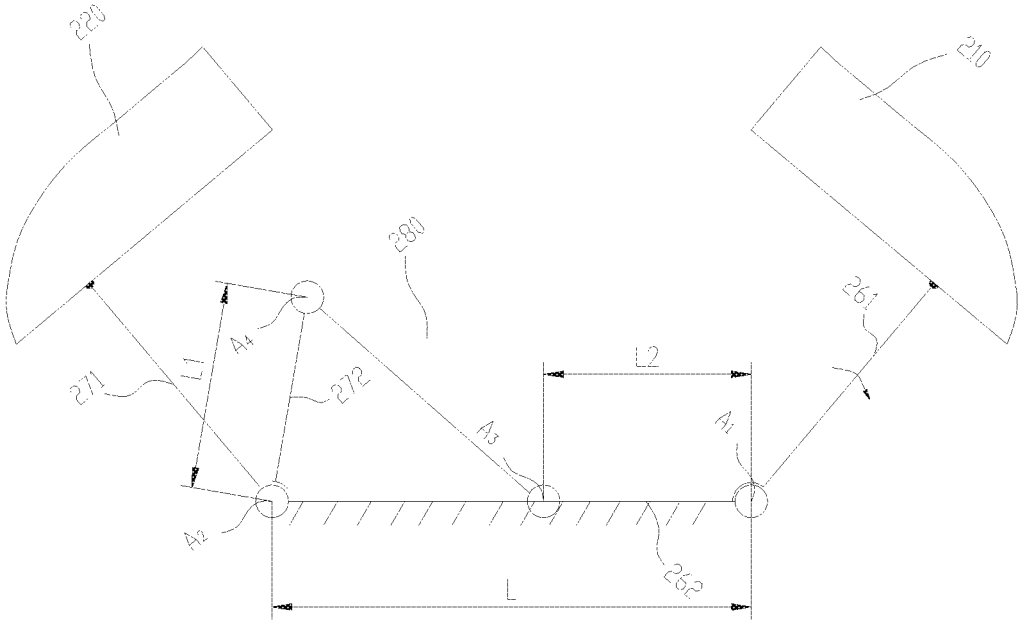
FIG. 8 is a schematic view showing the mechanism principle of FIG. 7.

Referring to FIGS. 5 and 8, FIG. 5 is a schematic view showing the transverse structure of a car body assembly of a freight train according to the present application with a loading opening in a closed state; FIG. 6 is a schematic view showing the mechanism principle of FIG. 5; FIG. 7 is a schematic view showing the transverse structure of the car body assembly of the freight train according to the present application with the loading opening in an opened state; and FIG. 8 is a schematic view showing the mechanism principle of FIG. 7.

Referring to FIGS. 5 and 7, the top cover opening and closing drive mechanism includes a cylinder 250, a driving rocker arm 260, a driven rocker arm 270 and a connecting rod 280. The driving rocker arm 260 and the driven rocker arm 70 are arranged corresponding to a left sub-top cover 210 and a right sub-top cover 220 respectively. Optionally, the driving rocker arm 260 and the driven rocker arm 270 are symmetrically arranged in a left-right direction with respect to a vertical center line of the front end wall.

The driving rocker arm 260 includes a driving main arm 261 and a driving auxiliary arm 262 which are fixedly connected to form an acute angle, and the driven rocker arm 270 also includes a driven main arm 271 and a driven auxiliary arm 272 which are fixedly connected to form an obtuse angle. The acute angle formed between the driving main arm 261 and the driving auxiliary arm 262 and the obtuse angle formed between the driven main arm 271 and the driven auxiliary arm 272 are complementary. Specifically, in this embodiment, the acute angle is 30° (degrees) and the obtuse angle is 150° (degrees).

It is to be noted that, the angles are not limited as long as the angle between the main arm and the auxiliary arm of one of the driving rocker arm 260 and the driven rocker arm 270 is greater than the angle between the main arm and the auxiliary arm of the other one of the driving rocker arm 260 and the driven rocker arm 270.

It can be known from FIG. 6 that, a top end of the driving main arm 261 is fixedly connected to the left sub-top cover 210, and a bottom end of the driving main arm 261 is hinged to the end wall. Similarly, a top end of the driven main arm 271 is fixedly connected to the right sub-top cover 220, and a bottom end of the driven main arm 271 is hinged to the end wall. The driving auxiliary shaft 262 and the driven auxiliary arm 272 are hinged by the connecting rod 280. A distance L1 from a hinge point $A_1$ of the driving main arm 261 and the end wall to a hinge point $A_3$ of the driving auxiliary arm 262 and the connecting arm 280 is equal to a distance L2 from a hinge point $A_2$ of the driven main arm 71 and the end wall to a hinge point $A_4$ of the driven auxiliary arm 272 and the connecting lever 280, and is less than a distance L from the hinge point $A_1$ of the driving main arm 261 and the end wall to the hinge point $A_2$ of the driven main arm 271 and the end wall.

The cylinder body of the cylinder 250 is hinged to the end wall, and a piston rod 251 of the cylinder 250 is hinged to the driving main arm 261 at a position between the hinge point $A_1$ of the driving main arm 261 and the end wall and a fixing point at which the driving main arm 261 is fixed to the left sub-top cover 210.

As shown in FIG. 5, when the left sub-top cover 210 and the right sub-top cover 2202 are joined, the piston rod 251 of the cylinder 250 is retracted into the cylinder body, and the distance from the hinge point $A_1$ of the driving main arm 261 and the end wall to the connecting point where the driving main arm 261 is fixedly connected to the left sub-top cover 210 is equal to the distance from the hinge point $A_2$ of the driven main arm 271 and the end wall to the connecting point where the driven main arm 271 is fixedly connected to the right-sub top cover 2202. The driving main arm 261 is in parallel with the drivers main arm 271, and the driving auxiliary arm 262 is in parallel with the driven auxiliary arm 272.

When the cylinder 250 is actuated, the piston rod 251 protrudes out from the cylinder body to push the driving rocker arm 260 to rotate about the hinge point $A_1$ of the driving rocker arm 260 and the end wall, till three points, including the hinge point $A_3$ of the driving auxiliary arm 262 and the connecting rod 280, the hinge point $A_1$ of the drive maim arm 261 and the end wall, and the hinge point $A_2$ of the driven main arm 271 and the end wall, are in the same line. Meanwhile, the connecting rod 280 drives the whole driven rocker arm 270 to rotate counterclockwise about the hinge point $A_2$ of the driven rocker arm 270 and the end wall, to be in a state in which the left sub-top cover 210 and the right sub-top cover 220 are in an opened state as shown in FIG. 6.

It may be appreciated that when the piston rod 251 is retracted by the cylinder 250, the driving rocker arm 260 and the driven rocker arm 270 rotate towards each other about the hinge points ($A_1$, $A_2$), where the driving rocker arm 260 and the driven rocker arm 270 are hinged to the end wall, to be in the state shown in FIG. 5.

It can be seen that, in this solution, the magnitude of the rotation angles, by which the two rocker arms rotate about the hinge points where they are hinged to the end wall, depend mainly on an included angle formed by the driving auxiliary arm 262 and the connecting line of the hinge points ($A_1$, $A_2$) of the end wall and the two rocker arms in a state that the two sub-top covers are joined. That is, in this solution, by adjusting the included angle between the driving auxiliary arm 262 and the connecting line of the hinge points (A1, A2) of the end wall and the two rocker arms, the opening degree of the loading opening of the car body can be adjusted, thus avoiding the issue in the conventional technology that the opening degree of the loading opening is too small due to the limitation of the space dimension of the connecting line of the hinge points of the end wall and the two rocker arms.

Further, in the above top cover opening and closing drive mechanism, the cylinder 250 is arranged horizontally, thus avoiding the issue that rainwater or goods enter the mating surface between the cylinder block of the cylinder 250 and the piston rod 251 to cause damages to the cylinder 250.

As shown in FIG. 5, in general conditions, in order to increase the capacity of the car body as much as possible to improve the transport capacity of a freight trains, a left side wall 230 and a right side wall 240 of the car body are each an arc-shaped plate protruding outwards. In order to utilize the special structure of the left side wall and the right side wall 240 and reduce the space occupied by the overall outer contour of the car body, the specific structures of the left sub-top cover 210 and the right sub-top cover 220 are further defined in this solution.

In detail, the left sub-top cover 210 and the right sub-top cover 220 each include a front end plate, a top plate and a rear end plate which are successively fixedly connected by welding, riveting or screws. The front end plates are located at the outside of the front end wall, and similarly, the rear end plates are located at the out side of the rear end wall. The top plates are circular arc-shaped plates, and the centers of the top plates are respectively the hinge points where the driving rocker arm 260 and the driven rocker arm 270 are hinged to the end wall. At least a segment, overlapping with the left sub-top cover 210, on the outer wall surface of the left side wall 230 is a circular arc-shaped surface, and the center of the circular arc-shaped surface is the central hinge point, and similarly, at least a segment, overlapping with the right sub-top cover 220, on the outer wall surface of the right side wall 240 is a circular arc-shaped surface, and the center of the circular arc-shaped surface is the central hinge point. It may be appreciated that on the premise of ensuring the smoothness of the rotation of the left sub-top cover 210 with respect to the left side wall 230 and the rotation of the right sub-top cover 220 with respect to the right side wall 240, the radius difference between an inner wall surface and an outer circular arc-shaped surface of the circular arc-shaped plate should be sufficiently small. In this embodiment, the radius difference between the inner wall surface and the outer circular arc-shaped surface of the circular arc-shaped plate may range from 15 mm to 25 mm, inclusive, to meet the requirement.

With this arrangement, as shown in FIG. 5, when the loading opening of the car body is closed, the left sub-top cover 210 and the right sub-top cover 220 are joined together to form a circular arc-shaped surface. A left end portion of the formed circular arc-shaped surface is substantially flush with an upper end portion of the left side wall 230, and a right end portion of the formed circular arc-shaped surface is substantially flush with an upper end portion of the right side wall 240. In other words, except the underframe, the outer contour of the car body is basically similar to a segment of major arc-shaped surface.

In the case that the loading opening of the car body is opened, the radial distance between the left sub-top cover 210 and the left side wall 230 is only the radius difference of the left sub-top cover 210 and the left side wall 230. Similarly, the radial distance between the right sub-top cover 220 and the right side wall 240 is only the radius difference of the right sub-top cover 220 and the right side wall 240. In this way, no matter which state the car body is in, the car body overall conforms with the current market demand for miniaturization development.

Further, in order to enable the car body overall to conform with the market demand for the lightweight development, the driving rocker arm 260 and the driven rocker arm 270 in this solution are each a frame structure formed by splicing and welding profile steels.

As shown in FIG. 7, in addition to the driving main arm 261 and the driving auxiliary arm 262, the driving rocker arm 260 further includes a transverse arm 262 and a reinforcement arm 263. An upper end portion of the main arm 261 is fixedly connected to the right sub-top cover 220 by welding, riveting or screwing. The transverse arm is perpendicularly fixedly connected to the main arm 261 and is also fixedly connected to the right sub-top cover 220 by welding, riveting or screwing. The main arm 261, the transverse arm 262 and the reinforcement arm 263 are fixedly connected to form a triangular frame structure.

The driven rocker arm 270 and the driving rocker arm 270 have the same structures and are symmetrically arranged in the left-right direction with respect to the midperpendicular of the end wall, and the person skilled in the art can obtain the structure of the driven rocker arm 270 directly and undoubtedly based on the structure of the driving rocker arm 260, therefore, the structure of the driven rocker arm 270 will not be described herein.

In addition, the main arm 261, the transverse arm 262, and the reinforcement arm 263 are all square steels. The triangular frame structure, formed by assembling the main arm 261, the transverse arm 262, and the reinforcement arm 263, has a high bearing strength and a light weight.

Of course, the structures of the driving rocker arm 260 and the driven rocker arm 270 are not limited to the above-described structures, and each of the driving rocker arm 260 and the driven rocker arm 270 may have any other structure commonly used in the art on the premise of achieving their respective functions.

Further, the above top cover opening and closing drive mechanism may further include a locking mechanism. When the loading opening of the car body is in a closed state, the locking mechanism is configured to lock the driving rocker arm 260 and the driven rocker arm 270, to prevent the loading opening from being opened unexpectedly under the action of an external load.

Figure 9:
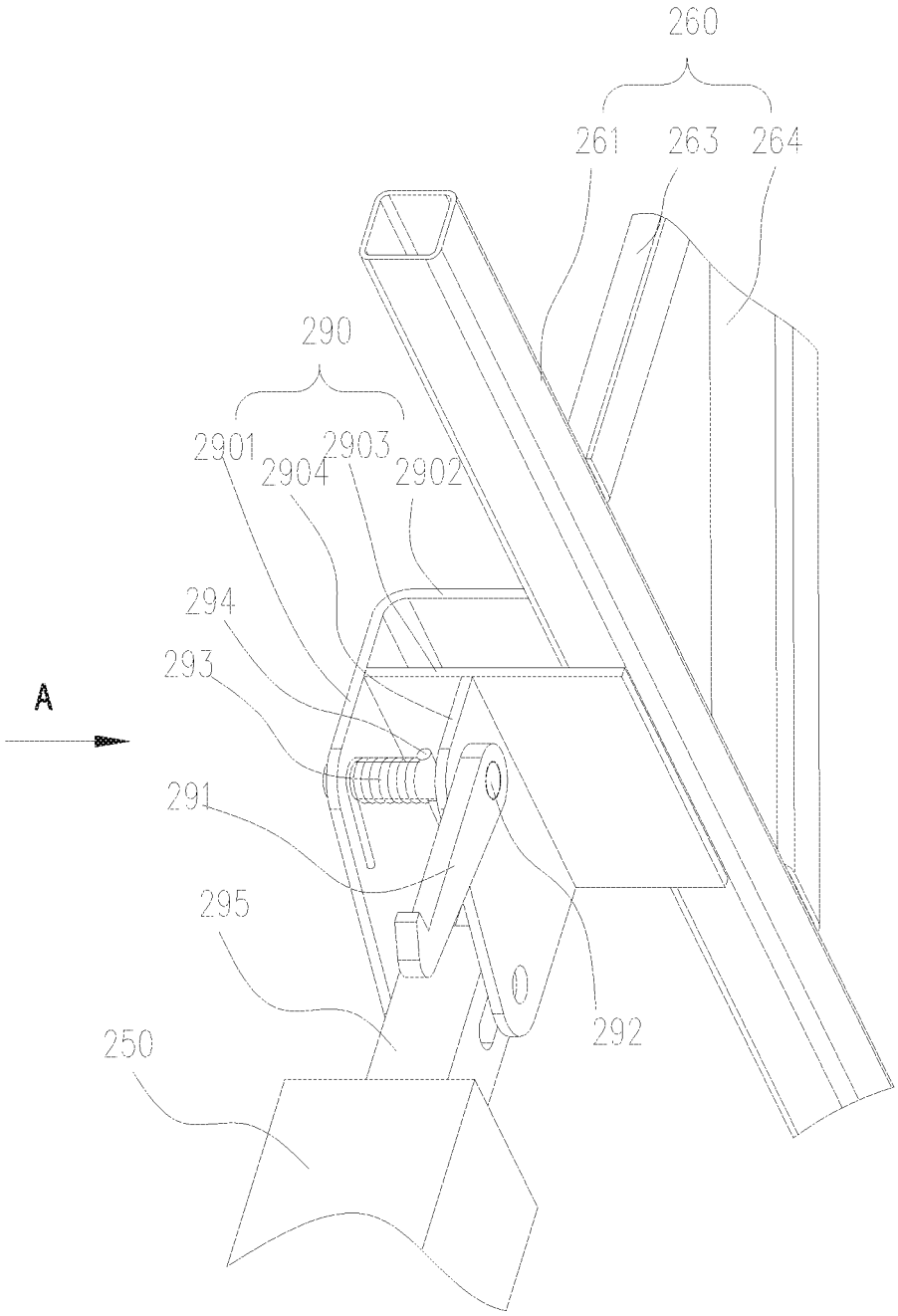
FIG. 9 is a schematic view showing the perspective structure of a locking structure of a top cover opening and closing drive mechanism in which the locking structure is in a locked state.
Figure 10:
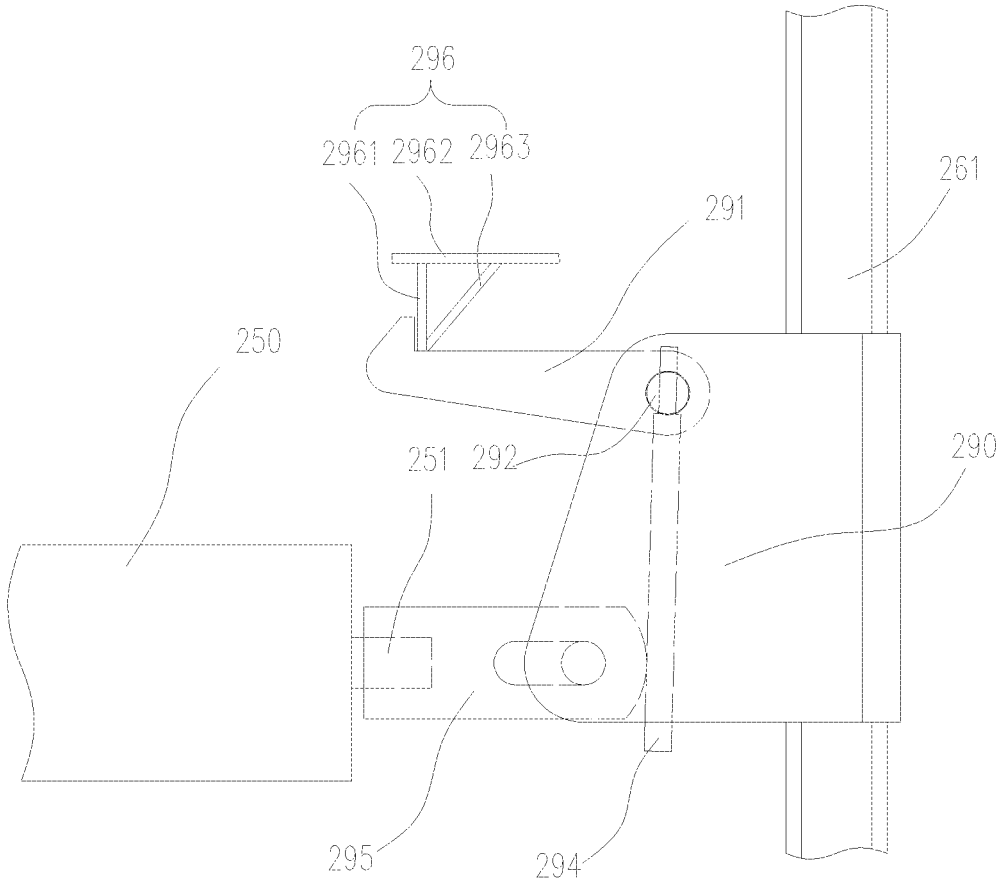
FIG. 10 is a schematic view showing the structure of FIG. 9 viewed in direction A.
Figure 11:
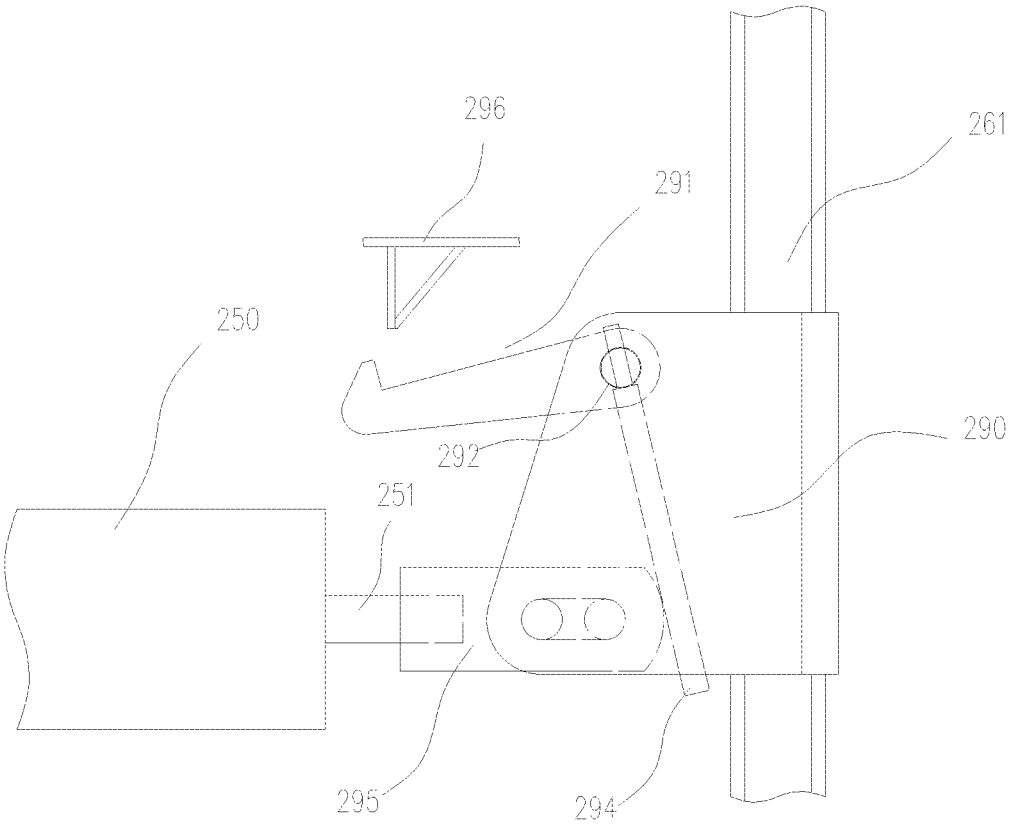
FIG. 11 is a schematic view showing the structure of the locking structure in an unlocked state.

Reference may be made to FIGS. 9 to 11, FIG. 9 is a schematic view showing the perspective structure of the locking structure of the top cover opening and closing drive mechanism in which the locking structure is in a locked state; FIG. 10 is a schematic view showing the structure of FIG. 9 viewed in direction A; and FIG. 11 is a schematic view showing the structure of the locking structure in an unlocked state.

As shown in FIG. 9, the locking mechanism includes a lock seat 290, a lock hook 291, a rotating shaft 292, a torsion spring 293, a push rod 294, a connecting plate 295, and a locking member 296. The lock seat 290 is fixedly connected to the driving rocker arm 260, and the rotating shaft 292 is rotatably connected to the lock seat 290. The push rod 294 is fixedly connected to the rotating shaft 292. The torsion spring 293 is sleeved on the rotating shaft 292, and has one torsional end fixedly connected to the lock seat 290 and another torsional end fixedly connected to the push rod 294. The connecting plate 295 is fixedly connected to the piston rod 251 and is provided with an elongated hole, and the lock seat 290 is hinged to the elongated hole through the rotating shaft 292, and can slide in the length direction of the elongated hole along with the rotating shaft 292. The locking member 296 is fixedly connected to the front end wall.

In the case that the loading opening of the car body is in a closed state as shown in the drawing, the rotating shaft 292 is driven to rotate clockwise under the action of the torsion force of the torsion spring 293, to further drive the lock hook 291 to rotate clockwise till abutting against a stop surface of the locking member 296, thereby restricting the driving rocker arm 260 from rotating clockwise with respect to the car body, that is, restricting the driving rocker arm 260 from rotating in a direction for opening the loading opening. Thus, the driving rocker arm 260 is locked with respect to the car body, and under the action of the connecting rod 280, the driven rocker arm 270 is also in a locked state, and thereby finally achieving the purpose of locking the left sub-top cover 210 and the right sub-top cover 220.

When it is necessary to open the loading opening of the car body, the piston rod 251 is extended to push the connecting plate 295 to slide along the length direction of its elongated hole with respect to the lock seat 290 by a predetermined distance, to in turn push the push rod 294 to overcome the torsion force of the torsion spring 293 to drive the rotating shaft 292 to rotate counterclockwise, and then the rotating shaft 292 drives the lock hook 291 to rotate about a hinge point of the lock hook 291 and the lock seat 290 till the lock hook 291 is disengaged from the lock member 296. In this case, the driving rocker arm 260 is in the unlocked state shown in FIG. 9, the piston rod 251 continues to extend to push the driving rocker arm 260 to rotate clockwise about the hinge point of the rocker arm 260 and the front end wall, and at the same time, under the action of the connecting rod, the driven rocker arm 270 rotates counterclockwise about the hinge point of the driven rocker arm 270 and the front end wall till the opening degree of the loading opening reaches a set value.

It is to be noted that, as described above, in this solution, the piston rod 251 and the lock seat 290 are connected by the connecting plate 295, and in particular, the connecting plate 295 is fixedly connected to the piston rod 251 and is provided with an elongated hinge hole extending along the extension direction of the piston rod 251. The lock seat 290 is hinged to the connecting plate 295 by a hinge shaft adapted to the width of the hinge hole, and under the action of the piston rod 251, the hinge shaft can slide in the length direction of the hinge hole.

It may be appreciated that the lock seat 290 can be directly hinged to the piston rod 251 and slide with respect to the direction of telescopic movement of the piston rod 251. In the case that the lock seat 290 and the piston rod 251 are connected through the connecting plate 295, the structure is simplified and the machining cost is reduced.

Further, in order to further reduce the entire weight of the car body of the freight train, the lock seat 290 and the locking member 296 are each a structure formed by splicing plates.

As shown in FIG. 9, the lock seat 290 includes a first plate member, a second plate member 2903 and a third plate member 2904. The first plate member is specifically a plate member bent into a right angle, that is, the first plate member includes a first plate body 2901 and a second plate body 2902 having an included angle of 90° (degrees) therebetween. The second plate member 2903 is perpendicularly fixedly connected to the first plate body 901, and the second plate member 2903 together with the second plate body 2902 form a U-shaped mounting groove for inserting and fixing a main arm 61 of the driving rocker arm 260. The third plate member 2904 is perpendicularly fixedly connected to the second plate member 2903, and the third plate member 2904 together with the first plate body 2901 form a U-shaped mounting groove, and the rotating shaft 292 is located in the U-shaped mounting groove and is rotatably connected to the third plate member 2904 and the first plate body 901.

As shown in FIG. 10, the locking member 296 includes a vertical plate 2961, a transverse plate 2962 and a reinforcement plate 2963. The vertical plate 2961, the transverse plate 2962, and the reinforcement plate 2963 are fixedly connected to form a triangular frame structure. The stop surface on the locking member 96, that is configured to abut against the lock hook 91 to lock the lock hook 91, is specifically an outer plate surface of the vertical plate 961.

The lock seat 290 and the locking member 296 are each formed by splicing multiple plates, and have characteristics such as having a light weight, a simple structure and a low manufacturing cost. It may be appreciated that, on the basis that the respective functions of the lock seat 290 and the locking member 296 can be met, the structures of the lock seat 290 and the locking member 296 are not limited to the above-described structures.

In addition, the present application further makes an improvement on the end wall of the car body on the basis of the above embodiments. Reference may be made to FIGS. 12 to 14, FIG. 12 is a schematic view showing the longitudinal structure of a car body assembly of a freight train according to the present application; FIG. 13 is a schematic view showing the transverse structure of the car body assembly of the freight train in FIG. 12; FIG. 14 is a schematic view showing the structure of the front end wall in FIG. 12.

As shown in FIG. 12, the car body assembly of the freight train generally includes an underframe 310, a top cover 320, a front end wall 330, a rear end wall 340, a left side wall 350, and a right side wall (not shown). The underframe 310, the front end wall 330, the rear end wall 340, the left side wall 350, and the right side wall are fixedly connected by welding, riveting or screwing, to form a box with a loading opening facing upward. The top cover 320 can move with respect to the box under the action of the top cover opening and closing drive mechanism 360, to control the opening and closing of the loading opening of the box.

The specific structures of the front end wall 330 and the rear end wall 340, i.e., the innovation point of the car body assembly of the freight train, are described hereinafter with reference to the drawings of the specification.

Since the rear end wall 340 and the front end wall 330 are symmetrically arranged with respect to the left side wall and the right side wall, and the rear end cover and the front end wall 330 have identical structures, the person skilled in the art can obtain the specific structure of one of the front end wall 330 and the rear end wall 340 directly and undoubtedly based on that the structure of another one of the front end wall 330 and the rear end wall 340. Therefore, the specific structures of the front end wall 330 and the rear end wall 340 are described hereinafter by taking the front end wall 330 as an example with reference to FIGS. 12 to 14 of the specification.

The front end cover includes a main body plate 3301, an outer wall surface of a lower part of the main body plate 3301 is flush with a front end surface of the underframe 310, and an upper part of the main body plate 3301 is concaved inwardly with respect to the lower part, to form a recess for accommodating the top cover opening and closing drive mechanism 360.

As shown in FIG. 14, the main body plate 3301 includes an upper inclined segment 3301*a*, an upper vertical segment 3301*b*, a lower inclined segment 3301*c* and a lower vertical segment 3301*d* which are successively arranged in the listed sequence in the vertical direction.

The upper inclined segment 3301*a* is formed by inclining inwards and extending downwards from an upper end portion of the main body plate 3301. The upper vertical segment 3301*b* is formed by vertically extending downwards from a lower end portion of the upper inclined segment 3301*a*. The lower inclined segment 3301*c* is formed by inclining outwards and extending downwards from a lower end portion of the upper vertical segment 3301*b*. The lower vertical segment 3301*d* is formed by extending downwards in the vertical direction from a lower end portion of the lower inclined segment 3301*c*. An outer wall surface of the lower vertical segment 3301*d* of the main body plate 3301 is flush with the front end surface of the underframe 310. The upper inclined segment 3301*a*, the upper vertical segment 3301*b* and the lower inclined segment 3301*c* form the recess for accommodating the top cover opening and closing drive mechanism 360.

It may be appreciated that, for the car body assembly of the freight train with the same specification, compared with the conventional flat-panel end wall, the capacity of the car body assembly is greatly increased by using the end wall having the above structure, and the increased capacity is twice the sum of the volume between the inner wall surfaces of the upper vertical segment 3301*b* and the upper inclined segment 3301*a*, the volume between the inner wall surfaces of the upper vertical segment 3301*b* and the lower inclined segment 3301*c*, and the volume between the inner wall surfaces of the upper vertical segment 3301*b* and the lower vertical segment 3301*d*. Therefore, this structure increases the capacity of the car body assembly as much as possible and improves the transport capacity of the freight train while meeting the requirement on the longitudinal clearance between adjacent two car body assemblies.

In addition, this kind of front end wall 330 includes the upper inclined segment 3301*a*, thus for the overall structure of the car body assembly of the freight train, the upper inclined segment 3301*a* of the front end wall 330, the upper inclined segment 3301*a* of the rear end wall 340, the left side wall 350, and the right side wall form a hopper-shaped loading opening.

Further, on the basis of forming the recess for mounting the top cover opening and closing drive mechanism 360, the upper vertical segment 3301*b* and the lower vertical segment 3301*d* of the front end wall 330 may also be transitionally connected by a horizontal segment extending in the longitudinal direction. However, compared with the solution using the horizontal transition portion extending longitudinally, the solution, in which the upper vertical segment 3301*b* and the lower vertical segment 3301*d* are transitionally connected by the lower inclined segment 3301*c*, may reduce the stress concentration at the transition joint, to enable the main body plate 3301 to have a strong mechanical strength overall.

Of course, on the basis of meeting the functions of mounting the top cover opening and closing drive mechanism 360 and increasing the capacity of the car body assembly, the specific structure of the main body plate 3301 may also be configured as follows, in the vertical direction, the main body plate 3301 may also only include the upper vertical segment 3301*b*, the lower inclined segment 3301*c*, and the lower vertical segment 3301*d* which are successively arranged in the listed sequence, that is, the upper end portion of the upper vertical segment 3301*b* is just the upper end portion of the entire main body plate 3301.

It may be appreciated that, in the above end walls of the two structures, the structure including the upper inclined segment 3301*a*, compared with the structure without the upper inclined segment 3301*a*, has advantages in two aspects. In one aspect, the upper inclined segment 3301*a* has a shielding effect to components of the cylinder of the top cover opening and closing drive mechanism 360 mounted in the recess, thus, in loading goods, it may prevent the goods from tailing into the components, such as the cylinder, of the top cover opening and closing drive mechanism 360 to accordingly cause damages to the components, and ensure the safety of the goods loading process. In the other aspect, the hopper-shaped loading opening of the car body assembly has a large size, and can improve the goods loading efficiency to a certain degree.

Further, as indicated by research that, in the case that an inclination angle $\alpha$ of the upper inclined segment 3301*a* with respect to the horizontal rail surface is equal to or greater than 40° (degrees), it can ensure a high goods loading efficiency at the loading opening while shielding and protecting the opening and closing drive mechanism 360 for the top cover 320.

In addition, in the case that an inclination angle $\beta$ of the lower inclined segment 3301*c* with respect to the horizontal rail surface ranges from 40° (degrees) to 60° (degrees), inclusive, the front end wall 330 has a better overall mechanical strength.

Referring again to FIG. 12, in addition to the cylinder, the top cover opening and closing drive mechanism 360 further includes an auxiliary member for connecting the cylinder and the top cover 320. Further, for preventing the auxiliary member from protruding with respect to the front end surface of the underframe 310 and occupying the space between adjacent two car body assemblies accordingly, the longitudinal length from the upper end portion of the maim body plate 3301 to the front end surface of the underframe 310 is further defined in this embodiment.

The upper end portion of the main body plate 3301 is located behind the front end surface of the underframe 310, and a longitudinal length H between the upper end portion of the main body plate 3301 and the front end surface of the underframe 310 is greater than or equal to a longitudinal length of the top cover opening and closing drive mechanism 360 with respect to the upper end portion of the main body plate 3301, thereby preventing the auxiliary member from, protruding with respect to the front end surface of the underframe 310 and occupying the space between the adjacent two car body assemblies accordingly.

Further, as shown in FIGS. 13 and 14, an outer wall surface of the connecting portion, where the lower inclined segment 3301*c* and the upper vertical segment 3301*b* of the main body plate 3301 are connected, and an outer wall surface of the connecting portion, where the lower inclined segment 3301*c* and the lower vertical segment 3301*d* of the main body plate 3301 are connected, are each provided with a transverse reinforcement rib extending transversely to enhance the overall mechanical strength of the front end wall 330.

An upper transverse reinforcement rib 3302 is provided at the connecting portion where the lower inclined segment 3301*c* and the upper vertical segment 3301*b* are connected. The upper transverse reinforcement rib 3302 is embodied as an angle steel, an end of one side arm of the upper transverse reinforcement rib 3302 is connected to the outer wall surface of the upper vertical segment 3301*b* by welding, and an end of another side arm of the upper transverse reinforcement rib 3302 is connected to an outer wall surface of the lower vertical segment 3301*d* by welding. Therefore, a square frame structure is formed by the upper transverse reinforcement rib 3302, the upper vertical segment 3301*b* and the lower vertical segment 3301*d*.

Similarly, a lower transverse reinforcement rib 3303 is also provided at the connecting portion where the lower inclined segment 3301*c* and the lower vertical segment 3301*d* are connected. The lower transverse reinforcement rib 3303 is embodied as an angle steel, an end of one side arm of the lower transverse reinforcement rib 3303 is connected to the lower inclined segment 3301*c* by welding, and an inner wall surface of another side arm of the lower transverse reinforcement rib 3303 abuts against the outer wall surface of the lower vertical segment 3301*d* and is connected to the outer wall surface of the lower vertical segment 3301*d* by welding.

In order to further enhance the overall mechanical strength of the front end wall 330, the main body plate 3301 is further provided with multiple vertical reinforcement ribs 3304 arranged successively at intervals in the transverse direction. Each of the vertical reinforcement ribs 3304 extends vertically from a lower end portion of the main body plate 3301 to an upper end portion of the main body plate 3301 along an outer wall surface of the main body plate 3301.

In addition, the upper end portion of the main body plate 3301 is further provided with an upper end sill 3305, the upper end sill 3305 extends transversely from a left end of the main body plate 3301 to a right end of the main body plate 3301. Each of the vertical reinforcement ribs 3304 has an upper end fixedly connected to the upper end sill 3305, and a lower end abutting against the upper end surface of the underframe 310 and fixedly connected to the upper end surface of the underframe 310.

Based on the opening and closing mechanism for the end bottom door in the above embodiments, a preferred embodiment of the opening and closing mechanism for the end bottom door is further provided herein and is described as follows.

Figure 15:
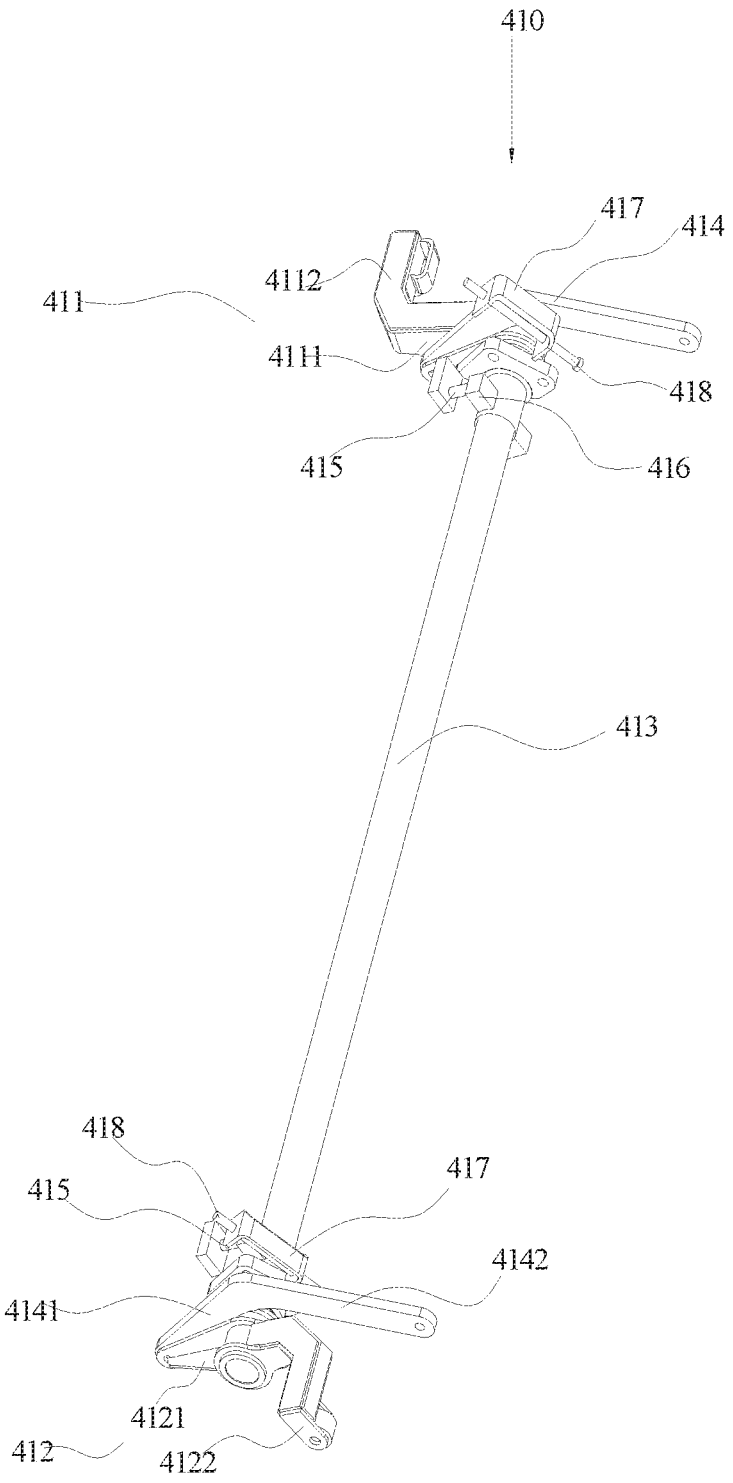
FIG. 15 is a schematic view showing the structure of an end bottom door opening and closing mechanism according to an embodiment.
Figure 16:
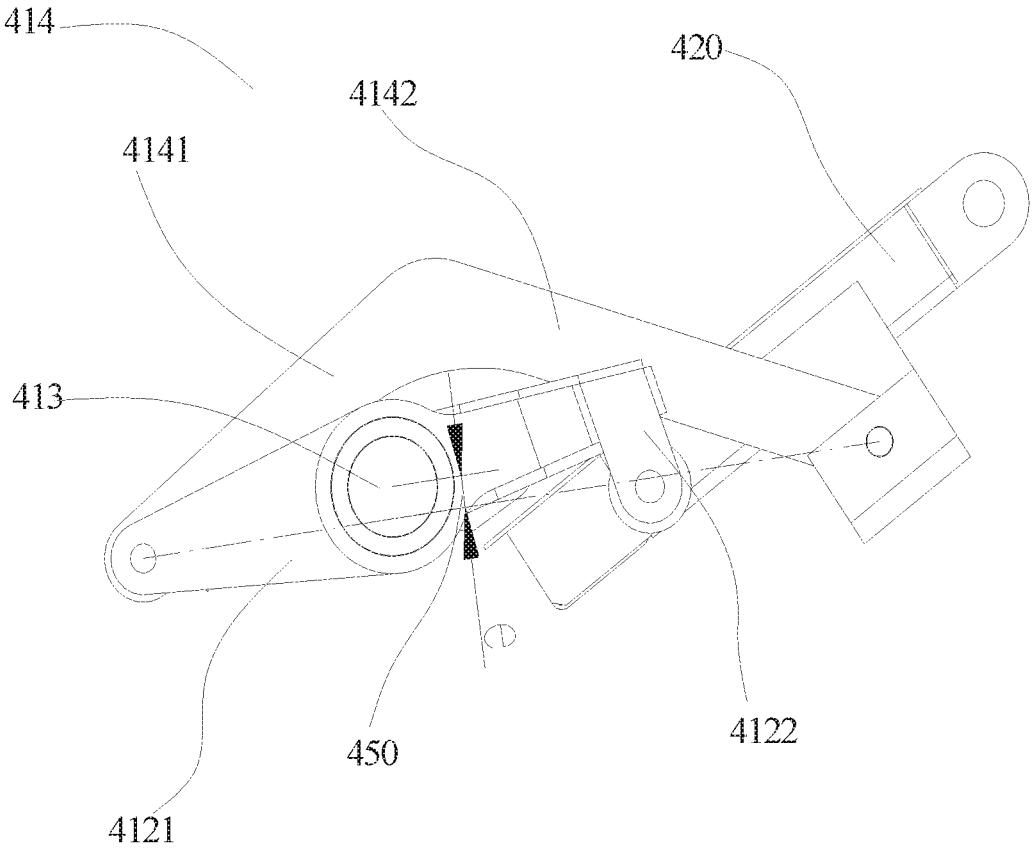
FIG. 16 is a schematic view showing a door closing arm viewed from the side of the shaft according to an embodiment.
Figure 17:
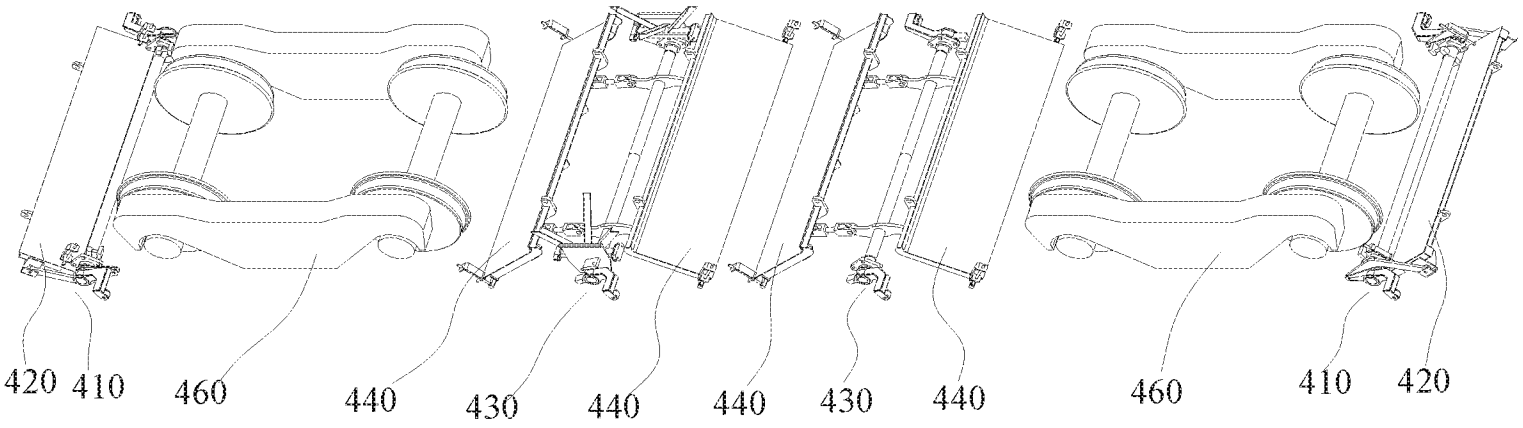
FIG. 17 is a schematic view showing the mechanism arrangement of an overall bottom door of the hopper car according to an embodiment.
Figure 18:
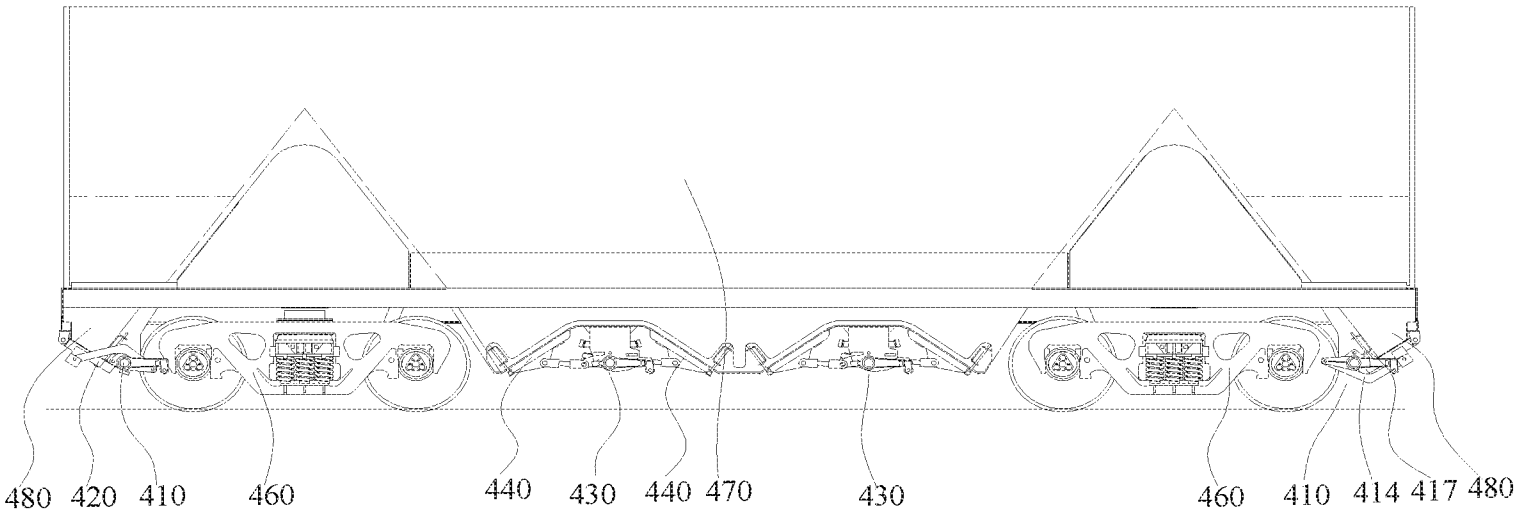
FIG. 18 is a schematic view showing the mechanism of the hopper car according to an embodiment.

Reference may be made to FIGS. 15 to 18, FIG. 15 is a schematic view showing the structure of an end bottom door opening and closing mechanism according to an embodiment; FIG. 16 is a schematic view showing a door closing arm viewed from the side of the shaft according to an embodiment; FIG. 17 is a schematic view showing the mechanism arrangement of an overall bottom door of the hopper car according to an embodiment; and FIG. 18 is a schematic view showing the mechanism of the hopper car according to an embodiment.

An end bottom door opening and closing mechanism 10 is provided according to the present application, and is configured to control the opening and closing of the end bottom door 420 of the hopper car, to realize the locking effect when the end bottom door 420 is opened or closed in the case that the end bottom door 420 is a single door. The end bottom door opening and closing mechanism 10 has a compact structure, and is easy to be installed at the end of the hopper car.

In a specific embodiment, the end bottom door opening and closing mechanism 10 includes a door opening arm 411, a door closing arm 412, a connecting shaft 413 and a connecting lever 414. As shown in FIG. 15, the door opening arm 411 and the door closing arm 412 are fixedly mounted at two ends of the connecting shaft 413 respectively. The door opening arm 411 and the door closing arm 412 can strike the strikers at corresponding sides, to thereby allowing the door opening arm 411 and the door closing arm. 412 to move actively to drive the connection shaft 413 to rotate. Moreover, the connecting lever 414 connected to the end bottom door 420 is provided, and the connecting lever 414 is a bent lever, that is, two connecting levers 414 are provided and are respectively connected to the side of the door opening arm 411 and the side of the door closing arm 412. Each of the connecting levers include a first bent lever 4141 and a second bent lever 4142 which are fixedly connected and are at a certain angle with respect to each other. One of the first bent lever 4141 and the second bent lever 4142 is hinged to the end bottom door 420, and the other one of the first bent lever 4141 and the second bent lever 4142 is hinged to the door opening arm 411 or the door closing arm 412 at the corresponding side, and each of the rotation axes of the hinge connection of the two connecting levers is in parallel with the connecting shaft 413.

When the hopper car needs to be unloaded, the hopper car moves to a specific position, the door opening arm 411 strikes the striker, to drive the connecting shaft 413 to rotate, and meanwhile drive the connecting lever 414 to rotate about the hinge point, and then the connecting lever 414 drives the end bottom door 420 to rotate. A side of the end bottom door 420, that is opposite to the hinge point of the end bottom door 420 and the second bent lever 4142 is hinged, is hinged to an end hopper bin 480. The connecting lever 414 drives the end bottom door 420 to rotate about the hinge point of the second bent lever 4142 and the end bottom door 420 and the hinge point of the end hopper bin 480 and the end bottom door 420, to thereby opening the end bottom door 420.

When the unloading process of the hopper car is finished, the door closing arm 412 of the hopper car strikes the striker at the corresponding side, and the door closing arm 412 rotates to drive the connecting lever 414 to rotate, and then drive the end bottom door 420 to rotate in a direction for closing the hopper opening of the hopper bin.

In the case that the end bottom door 420 is opened to a certain position or is closed, the connecting lever 414 having a locking function is formed by the first bent lever 4141 and the second bent lever 4142 and is utilized to limit the position of the movement of the end bottom door 420. That is, the first bent lever 4141 and the second bent lever 4142 form a locking bent lever having an integral structure. When opening and closing the end bottom door 420 embodied as a single door, the connecting lever 414 effectively realizes self-locking, thus ensuring the stability of the opened and closed state of the end bottom door 420.

The axis of the connecting shaft 413 is located within a space formed by the bending part of the connecting lever 414, that is, the joint between the first bent lever 4141 and the second bent lever 4142 just crosses over the connecting shaft 413, as shown in FIG. 16. With this arrangement, the strength of the connecting lever 414 can be improved, and the stability of the locked position in opening and closing the end bottom door 420 can be improved.

In the case that two ends of the hopper car are both provided with the end bottom door 420, the two end bottom doors 420 have opposite opening directions and opposite closing directions, to optimize the structure and enhance the compactness of the whole car mechanism. Correspondingly, the connecting levers 414 in the end bottom door opening and closing mechanisms 10 at the two ends of the hopper car should be arranged oppositely, i.e., taking the position of the hopper car as a reference, the connecting lever 414 at one end of the hopper car is located above the connecting shaft 413, and the connecting lever 414 at another end of the hopper car is located below the connecting shaft 413. Referring to FIG. 17 which shows an opened state of the end bottom doors 420, the side, connected to the connecting lever 414, of each of the end bottom doors 420 is inclined upward, thereby opening both the end bottom, doors 420 at the two ends; and when the end bottom doors 420 are closed from this state, the side, connected to the connecting lever 414, of each of the end bottom doors 420 is rotated and tilted downwardly to gradually close the end bottom doors 420.

In this way, the opening and closing of the end bottom doors 420 at the two ends are both achieved, and moreover, the space is optimized.

The striker is a structure which is arranged at a specific position on the ground and is configured to open or close the end bottom door 420 when the hopper car reaches a specified position. Reference may be made to the striker in the conventional technology for opening and closing the middle bottom door opening and closing mechanism 430, they have the same structures and operation principles.

It is to be noted that, the term "first, second" are used herein to define the two bent levers of the connecting lever 414, which is only intended to clearly describe the technical solution and does not limit the technical solutions claimed in the present application.

In a specific embodiment, the first bent lever 4141 is hinged to the door opening arm 411 or the door closing arm 412, and the second bent lever 4142 is hinged to the end bottom door 420. Of course, it is also practical that, the first bent lever 4141 is hinged to the end bottom door 420, and the second bent lever 4142 is hinged to the door opening arm 411 or the door closing arm 412. Or, the bent lever that is hinged to the door opening arm 411 or the door closing arm 412 is defined as the second bent lever 4142, and the bent lever that is hinged to the end bottom door 420 is defined as the second bent lever 4142.

Further, an angle formed between the first bent lever 4141 and the second bent lever 4142 is an obtuse angle. In the specific embodiment, the angle is set approximately close to 180 degrees, as long as it can enable the connecting lever 414 to have a certain bent angle. The closer the angle is to 180 degrees, the higher the stability of the connecting lever 414 is and the higher the connection strength of the connecting lever 414 is.

Further optimized design may be made for the door opening arm 411 and the door closing arm 412. The optimized door opening arm 411 includes a door opening arm shaft 4111 and a door opening arm head 4112 perpendicularly connected to an end of the door opening arm shaft 4111. A middle portion of the door opening arm shaft 4111 is provided with a fixedly connection hole configured to fixedly connected to an end of the connecting shaft 413. At another end away from the door opening arm head 4112, the door opening arm shaft 4111 is hinged to the connecting lever 414. Correspondingly, the door closing arm shaft 4121 includes a door closing arm 412 and a door closing arm shaft 4122 perpendicularly connected the door closing arm shaft 4121, and a middle portion of the door closing arm shaft 4121 is also provided with a fixedly connection hole configured to fixedly connected to another end of the connecting shaft 413.

This arrangement facilitates installing the door opening arm 411 and the door closing arm 412 in one aspect, and provides a support for the installation of the connecting lever 414 in another aspect.

In a specific embodiment, as shown in FIG. 16, a predetermined distance 450 is provided between the center of the connecting shaft 413 and a connecting line of the two hinge points of the connecting lever 414. That is, when installing the connecting lever 414, a certain eccentricity is provided between the connecting line of the hinge points of the first bent lever 4141 and the second bent lever 4142 and the center line of the connecting shaft 413, to support the opening of the end bottom door 420.

In order to effectively ensure the opening of the end bottom door 420 and ensure the stability of the end bottom door 420, the above predetermined distance 450 needs to be further defined. Reference may be made to FIGS. 15 and 16 together.

In a specific embodiment, the end bottom door opening and closing mechanism 10 further includes an adjustment assembly configured to adjust the above predetermined distance 450, to limit the predetermined distance 450 within a certain range. In one aspect, the adjustment assembly prevents the predetermined distance 450 from becoming large and ensures that the end bottom door 420 can be opened smoothly; and in another aspect, the adjustment assembly prevents the predetermined distance 450 from becoming small and ensures the stability of the end bottom door 420.

The adjustment assembly includes an adjusting rod 415 and a limit stop 416 fixed to the connecting shaft 413. The adjusting rod 415 has one end fixed to the car body 470 and another end connected to the limit stop 416. The adjusting rod 415 can adjust the connection distance between the connecting shaft 413 and the car body 470, that is, the distance between the connecting shaft 413 and the car body 470 can be adjusted by changing the connection length, thereby defining the installation position of the connecting shaft 413. With this arrangement, the position of the connecting shaft 413 can be adjusted in the installation process in one aspect; and in another aspect, when the load on the end bottom door 420 is increased and the predetermined distance 450 has a tendency of becoming large, an effective support can be provided by the limitation of the adjusting rod 415 and the limit stop 416, to restrict the predetermined distance 450 from becoming large.

The adjustment assembly further includes an elastic member. The elastic member is fixedly connected to the end hopper bin 480 of the hopper car, and after being preloaded, the elastic member abuts against die inner wall of the end bottom door 420. That is, by applying the preloading force of the elastic member on the end bottom door 420, the distance between the end bottom door 420 and the end hopper bin 480 is limited, so that the above-mentioned predetermined distance 450 is prevented from becoming small when the hopper is not loaded, and the stability of the end bottom door 420 is ensured. Reference may be further made to FIG. 18.

The adjusting rod 415 is embodied as a screw rod threadedly connected to the limit stop 416, and a fixing block fixedly connected to the car body 470 is provided at an end of the screw rod. That is, with the threaded connection between the screw rod and the limit stop 416, the connection length of the screw rod can be changed, thereby adjusting the distance between the connecting shaft 413 and the car body 470, and with the fixing block, the stability of the connection between the screw rod and the car body 470 is improved.

Of course, the adjusting rod 415 is not limited to the screw rod, and the car body 470 may also be connected to the limit stop 416 by other structures as long as the structure can connect the limit stop 416 to the car body 470 and have an adjustable connection length.

As shown in FIG. 15, the adjustment assembly may further include a U-shaped frame 417 and a bearing rod 418 extending through two side walls of the U-shaped frame 417, and the above elastic member is a spring which is not shown in the drawings. The bottom of the U-shaped frame 417 is fixed to the end hopper bin 480. A protruding end of the bearing rod 418 is fixed to the inner wall of the end bottom door 420, and the spring sleeved on the bearing rod 418 has one end fixed to an inner wall of the U-shaped frame 417 and another end fixed to the bearing rod 418. In this way, the spring is compressed and deformed in the U-shaped frame 417 to generate a preloading force, and abuts against the end bottom door 420 through the bearing rod 418. Thus, the structure is simple, and is easy to install and implement.

In addition to the above-described end door opening and closing mechanism 10, a hopper car having the end door opening and closing mechanism 10 is further provided according to the present application, and the end bottom door 420 of the hopper car is controlled to be opened and closed by the above end door opening and closing mechanism 10.

As shown in FIGS. 17 and 18, two middle bottom door opening and closing mechanisms 430 and corresponding two pairs of middle bottom doors 440 are provided at the middle portion of the hopper car. During the operation of the hopper car, the middle bottom door opening and closing mechanism 430 control the middle bottom door 440 to open and close, and the end bottom door opening and closing mechanism 10 controls the end bottom door 420 to open and close, and the middle bottom door opening and closing mechanism 430 and the end bottom door opening and closing mechanism 10 act synchronously. Synchronous opening and synchronous closing refer to that the middle bottom door opening and closing mechanism 430 and the end bottom door opening and closing mechanism 10 are all performing the opening operation or the closing operation successively.

It is to be noted that, the number of the middle bottom door opening and closing mechanism 430 and the number of the middle bottom door 440 are designed according to the length of the hopper car, and therefore, the number of the middle bottom door opening and closing mechanism 430 and the number of the middle bottom door 440 do not constitute a limitation to the technical solutions claimed in the present application.

In addition, the end and the middle part of the hopper car are defined by taking the bogie 460 as the reference, and as shown in FIGS. 17 and 18, the part located between the two bogies 460 is defined as the middle part of the hopper car, and the part located outside the bogie 460 is defined as the end of the hopper car.

The hopper car employs the arrangement of the end bottom door opening and closing mechanism 10 and the end bottom door 420 in cooperation with the middle bottom door opening and closing mechanism 430 and the middle bottom door 440, thus making full use of the space of the hopper car and improving the working efficiency of the hopper car.

Further, a freight train is further provided according to the present application, which includes a locomotive and at least one car body assembly, and the car body assembly is the car body assembly according to any one of the above embodiments.

Other parts of the freight train may refer to the conventional technology, and will not be described herein.

Since the freight train includes the car body assembly having the above-described beneficial effects, the freight train also has the above-described beneficial effects of the car body assembly.

The freight train and the car body assembly thereof according to the present application have been described in detail hereinbefore. The principle and the embodiments of the present application are illustrated herein by specific examples. The above description of examples is only intended to help the understanding of the method and concept of the present application. It should be noted that, for those skilled in the art, a few of modifications and improvements may be made to the present application without departing from the principle of the present application, and these modifications and improvements are also deemed to fall into the scope of protection of the present application defined by the claims.

What is claimed is:

1. A car body assembly of a freight train, comprising at least two bogies, and an underframe and a car body both supported on the two bogies, wherein the car body comprises a middle car body, and a discharge opening of the middle car body is arranged between the two bogies, and at least one end of the middle car body is further provided with an end car body, and a predetermined space is defined above the respective bogie by adjacent end walls of the middle car body and the end car body;

wherein:

the car body assembly of the freight train further comprises a top cover opening and closing drive mechanism and two sub-top covers of the car body assembly, wherein, the two sub-top covers are arranged symmetrically in a left-right direction with respect to a traveling direction of the train, and the top cover opening and closing drive mechanism is configured to drive the two sub-top covers to oppositely rotate with respect to the car body to be joined or separated;

the top cover opening and closing drive mechanism comprises a cylinder and two rocker arms arranged corresponding to the two sub-top covers respectively and fixedly connected to the two sub-top covers respectively, and the two rocker arms are each hinged to an end wall of the car body, and are hinged to each other by a connecting rod, and the cylinder is configured to drive one of the two rocker arms to rotate about a hinge point of the corresponding rocker arm and the end wall, and in a case that a loading opening of the car body is in a closed state, the two rocker arms are in parallel with each other; a hinge point, where one of the two rocker arms is hinged to the connecting rod, is located above a connecting line between hinge points where the two rocker arms are hinged to the end wall; and a hinge point, where the other one of the two rocker arms is hinged to the connecting rod, is located below the connecting line between the hinge points where the two rocker arms are hinged to the end wall.

2. The car body assembly of the freight train according to claim 1, wherein a bottom of the end car body is further provided with a discharge opening, the discharge opening is arranged at an outside of the respective bogie, and the discharge opening is equipped with an end bottom door mechanism.

3. The car body assembly of the freight train according to claim 1, wherein the number of the end car body is two, and the two end car bodies are arranged at two ends of the middle car body respectively, outer end walls of the two end car bodies form two end walls of the car body, the car body assembly further comprises a top cover, and the top cover covers a top opening enclosed by side walls and the outer end walls of the car body.

4. The car body assembly of the freight train according to claim 1, wherein a bottom of the end car body is further provided with a ridge structure extending longitudinally, the ridge structure protrudes upward to form an inverted V-shaped structure, and a first discharge opening and a second discharge opening which are in communication with an inner cavity of the end car body are respectively provided at two side of the ridge structure.

5. The car body assembly of the freight train according to claim 4, wherein lower ends of two side walls of the ridge structure fit close to the underframe, and the two side walls of the ridge structure and an upper surface of the underframe form a communication passage extending through a bottom portion of the end car body, and the predetermined space is in communication with an outer end wall of the end car body via the communication passage; and a longitudinal center sill is arranged on the underframe at a position corresponding to the ridge structure, the two side walls of the ridge structure abut against the center sill and are supported by the center sill, and the two side walls of the ridge structure and the center sill form the communication passage.

6. The car body assembly of the freight train according to claim 1, wherein the adjacent end walls of the middle car body and the end car body are respectively a first flat plate of the middle car body and a second flat plate of the end car body, and the first flat plate and the second flat plate form a triangular space with an opening facing downwards.

7. The car body assembly of the freight train according to claim 1, wherein the number of the end car body is two, and the two end car bodies are respectively arranged at two ends of the middle car body, outer end walls of the two end car bodies form two end walls of the car body, and the two outer end walls are flat plates arranged vertically.

8. The car body assembly of the freight train according to claim 1, wherein a distance from the hinge point of the end wall and one of the two rocker arms to the hinge point of the connecting rod and the respective rocker arm is equal to a distance from the hinge point of the end wall and the other one of the two rocker arms to the hinge point of the connecting rod and the respective rocker arm, and the distances are less than a length of the connecting line between the hinge points where the two rocker arms are hinged to the end wall.

9. The car body assembly of the freight train according to claim 8, wherein each of the two rocker arms comprises a main arm and an auxiliary arm, an angle formed between the main arm and the auxiliary arm, after being fixedly connected, of one of the two rocker arms is greater than an angle formed between the main arm and the auxiliary arm, after being fixedly connected, of the other one of the two rocker arms; and a top end of the main arm is fixedly connected to the respective sub-top cover, and a bottom end of the main arm is hinged to the end wall, and the auxiliary arms of the two rocker arms are hinged by the connecting rod.

10. The car body assembly of the freight train according to claim 1, further comprising a locking mechanism configured to restrict the two sub-top covers from oppositely rotating in a state that the two sub-top covers are joined, wherein, the locking mechanism comprises a lock seat, a rotating shaft, a lock hook, a push rod, a torsion spring and a locking member, the lock seat is fixedly connected to one of the two rocker arms, the lock seat is rotatably connected to the piston rod and is slidable with respect to the piston rod in a telescoping direction of the piston rod, the rotating shaft is hinged to the lock seat and fixedly connected to both the lock hook and the push rod; the torsion spring is sleeved on the rotating shaft, and has one torsional end fixedly connected to the lock seat and another torsional end fixedly connected to the push rod, and the locking member is fixedly connected to the end wall, and in a locked state, the lock hook abuts against a stop surface of the locking member under the action of a torsional force of the torsion spring, and the piston rod extends with respect to the lock seat to push the push rod to overcome the torsional force of the torsion spring, to drive the lock hook to rotate to be disengaged from the locking member, to allow the locking mechanism to be switched into an unlocking state.

11. A freight train, comprising a locomotive and at least one car body assembly, wherein the car body assembly is the car body assembly according to claim 1.

12. A car body assembly of a freight train, comprising at least two bogies, and an underframe and a car body both supported on the two bogies, wherein the car body comprises a middle car body, and a discharge opening of the middle car body is arranged between the two bogies, and at least one end of the middle car body is further provided with an end car body, and a predetermined space is defined above the respective bogie by adjacent end walls of the middle car body and the end car body; and wherein the car body assembly of the freight train, further comprises an end wall, wherein the end wall comprises a main body plate, an outer wall surface of a lower part of the main body plate is flush with a front end surface of the underframe of the car body assembly of the freight train, and an upper part of the main body plate is inwardly concaved with respect to the lower part of the main body plate to form a recess, and the recess is configured to accommodate a top cover opening and closing drive mechanism of the car body assembly of the freight train.

13. The car body assembly of the freight train according to claim 12, wherein, in a vertical direction, the main body plate comprises an upper inclined segment inclined inwards from an upper end portion of the main body plate and extending downwards, an upper vertical segment extending downwards from the upper inclined segment, a lower inclined segment inclined outwards from the upper vertical segment and extending downwards, and a lower vertical segment extending downwards from the lower inclined segment which are arranged successively, and an outer wall surface of the lower vertical segment is flush with the front end surface of the underframe, and the recess is formed by the upper inclined segment, the upper vertical segment and the lower inclined segment.

14. The car body assembly of the freight train according to claim 13, wherein a longitudinal length from the upper inclined segment to an outer wall surface of the upper vertical segment is greater than or equal to a longitudinal length from the upper inclined segment to a front end surface of the top cover opening and closing drive mechanism.

15. A car body assembly of a freight train, comprising at least two bogies, and an underframe and a car body both supported on the two bogies, wherein the car body comprises a middle car body, and a discharge opening of the middle car body is arranged between the two bogies, and at least one end of the middle car body is further provided with an end car body, and a predetermined space is defined above the respective bogie by adjacent end walls of the middle car body and the end car body; and wherein, the car body assembly of the freight train comprises an end bottom door opening and closing mechanism configured to open and close an end bottom door of a hopper car, wherein the end bottom door opening and closing mechanism comprises:

a door opening arm configured to open the end bottom door;

a door closing arm configured to close the end bottom door;

a connecting shaft having two ends respectively connected the door opening arm and the door closing arm, wherein the door opening arm and the door closing arm are configured to drive the connecting shaft to rotate; and two connecting levers respectively connected to a side corresponding to the door opening arm and a side corresponding to the door closing arm, wherein each of the connecting levers comprises a first bent lever and a second bent lever which are fixedly connected and are at a certain angle with respect to each other, one of the first bent lever and the second bent lever is hinged to the end bottom door, and the other one of the first bent lever and the second bent lever is hinged to the door opening arm or the door closing arm at the corresponding side, and rotation axes of the hinge connection of the first bent lever and the second bent lever are both in parallel with the connecting shaft.

16. The car body assembly of the freight train according to claim 15, wherein the door opening arm comprises a door opening arm shaft and a door opening arm head perpendicularly connected to one end of the door opening arm shaft, the door closing arm comprises a door closing arm shaft and a door closing arm head perpendicularly connected to one end of the door closing arm shaft; a middle part of each of the door opening arm shaft and the door closing arm shaft is provided with a fixedly connection hole configured to fixedly connect the door opening arm shaft or the door closing arm shaft to the connecting shaft, and the connecting levers are respectively hinged to another end of the door opening arm shaft and another end of the door closing arm shaft at the corresponding sides.

17. The car body assembly of the freight train according to claim 15, wherein the angle formed by the first bent lever and the second bent lever is an obtuse angle.

18. The car body assembly of the freight train according to claim 15, wherein a predetermined distance is provided between a center line of the connecting shaft and a connection line of the two hinge points of the connecting lever;

the end bottom door opening and closing mechanism further comprises an adjustment assembly, and the adjustment assembly is configured to adjust the predetermined distance, to limit the predetermined distance within a certain range; and the adjustment assembly comprises:

an adjusting rod, and a limit stop fixed to the connecting shaft, wherein the adjusting rod has one end fixed to the car body and another end connected to the limit stop, and is configured to adjust a connection distance between the connecting shaft and the car body; and an elastic member fixedly connected to an end hopper bin of the hopper car, wherein the elastic member in a preloaded state abuts against an inner wall of the end bottom door, to define a distance between the end bottom door and the end hopper bin.

19. The car body assembly of the freight train according to claim 18, wherein the adjustment assembly further comprises a U-shaped frame and a bearing rod, each of two side walls of the U-shaped frame is provided with a guide hole, and the bearing rod passes through the guide holes and is movable along the guide holes, and the elastic member is a spring; a bottom of the U-shaped frame is fixed to the end hopper bin, and the bearing rod has a protruding end fixed to the inner wall of the end bottom door, and the spring sleeved on the bearing rod has one end fixed to an inner wall of the U-shaped frame and another end fixed to the bearing rod.

* * * * *